US010283265B2

(12) United States Patent
Kodama et al.

(10) Patent No.: US 10,283,265 B2
(45) Date of Patent: May 7, 2019

(54) METHOD OF MANUFACTURING AMORPHOUS ALLOY MAGNETIC CORE

(71) Applicant: HITACHI METALS, LTD., Minato-ku, Tokyo (JP)

(72) Inventors: Hitoshi Kodama, Yasugi (JP); Kengo Takahashi, Yasugi (JP); Daichi Azuma, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 275 days.

(21) Appl. No.: 15/513,990

(22) PCT Filed: Sep. 24, 2015

(86) PCT No.: PCT/JP2015/076998
§ 371 (c)(1),
(2) Date: Mar. 24, 2017

(87) PCT Pub. No.: WO2016/047717
PCT Pub. Date: Mar. 31, 2016

(65) Prior Publication Data

US 2017/0294267 A1 Oct. 12, 2017

(30) Foreign Application Priority Data

Sep. 26, 2014 (JP) ..... 2014-197344

(51) Int. Cl.
*H01F 41/02* (2006.01)
*H01F 1/153* (2006.01)
(Continued)

(52) U.S. Cl.
CPC ..... *H01F 41/0226* (2013.01); *H01F 1/153* (2013.01); *H01F 3/04* (2013.01); *H01F 27/25* (2013.01)

(58) Field of Classification Search
CPC ..... H01F 1/153; H01F 3/04; H01F 27/25; H01F 41/0226
See application file for complete search history.

(56) References Cited

FOREIGN PATENT DOCUMENTS

CA 1 148 229 * 6/1983
JP S48-16306 U 2/1973
(Continued)

*Primary Examiner* — Carl J Arbes
(74) *Attorney, Agent, or Firm* — SOLARIS Intellectual Property Group, PLLC

(57) ABSTRACT

A method of manufacturing an amorphous alloy magnetic core, which includes preparing a layered body by layering amorphous alloy thin strips one on another, and has one end face and another end face in a width direction of the thin strips and an inner peripheral surface and an outer peripheral surface orthogonal to a layering direction of the thin strips; forming a hole passing through from the one end face of the layered body as a starting point; subjecting the layered body to which the hole has been formed to a heat treatment while measuring an internal temperature of the hole; and forming a resin layer which blocks the hole and covers at least a part of the one end face by coating and curing a two-liquid mixed type epoxy resin composition having a viscosity of from 38 Pa·s to 51 Pa·s and a T. I. value of from 1.6 to 2.7 on at least a part of at least the one end face of the layered body after being subjected to the heat treatment.

10 Claims, 9 Drawing Sheets

(51) Int. Cl.
*H01F 27/25* (2006.01)
*H01F 3/04* (2006.01)

(56) References Cited

FOREIGN PATENT DOCUMENTS

| | | | |
|---|---|---|---|
| JP | S52-615 | U | 1/1977 |
| JP | S60-169117 | A | 9/1985 |
| JP | S61-180410 | A | 8/1986 |
| JP | H06-346219 | A | 12/1994 |
| JP | H07-9858 | B2 | 2/1995 |
| JP | 2001-510508 | A | 7/2001 |
| JP | 2001-338823 | A | 12/2001 |
| JP | 2007-234714 | A | 9/2007 |

* cited by examiner

METHOD OF MANUFACTURING AMORPHOUS ALLOY MAGNETIC CORE

TECHNICAL FIELD

The present invention relates to a method of manufacturing an amorphous alloy magnetic core.

BACKGROUND ART

Amorphous alloys have been employed as a material for a magnetic core (core) of a transformer for power distribution, a transformer for electronic and electric circuit, and the like since they exhibit excellent magnetic properties.

Magnetic cores made of amorphous alloys (hereinafter, referred to as the "amorphous alloy magnetic core") can suppress the loss of electric current at the time of no load to about ⅓ as compared to magnetic cores made of silicon steel plates (electromagnetic steel plate), and they have been thus expected as a magnetic core adaptable to energy saving in recent years.

An amorphous alloy thin strip (amorphous alloy ribbon) to be used in fabrication of amorphous alloy magnetic cores is manufactured by discharging a molten alloy onto a cooling roll that is made of a copper alloy and rotates from a nozzle by a single roll method and rapidly cooling the molten alloy.

The amorphous alloy magnetic cores are often subjected to a heat treatment after being fabricated by layering amorphous alloy thin strips one on another in order to impart proper magnetic properties to the amorphous alloy magnetic cores.

For example, Japanese Patent Application Laid-Open (JP-A) No. 2007-234714 discloses the relation between the heat treatment temperature of an amorphous alloy magnetic core and the iron loss (core loss) or Hc (coercive force) of the amorphous alloy magnetic core.

In addition, Japanese National-Phase Publication (JP-A) No. 2001-510508 discloses the relation between the heat treatment temperature of an amorphous alloy magnetic core and the excitation force of the amorphous alloy magnetic core.

In addition, with regard to the amorphous alloy magnetic core described above, it is disclosed in Japanese Patent Publication (JP-B) No. H7-9858 that the end portion in the width direction of the layered amorphous alloy thin strips is covered with a bonding layer for the purpose of suppressing the missing of a part of the end portion of the layered amorphous alloy thin strips, and the like.

SUMMARY OF INVENTION

Technical Problem

As disclosed in JP-A No. 2007-234714 and JP-A No. 2001-510508, it is important to subject the amorphous alloy magnetic core to a heat treatment under a proper heat treatment condition in order to impart proper magnetic properties to the amorphous alloy magnetic core.

However, there is a problem in the conventional amorphous alloy magnetic core that it is difficult or cumbersome to optimize the heat treatment condition. The reason for this is that the internal temperature profile of the magnetic core is not often consistent with the surface temperature profile of the magnetic core during the heat treatment. Hence, the final heat treatment condition has been hitherto often determined by repeating the adjustment of the heat treatment condition while confirming the relation between the heat treatment condition and the magnetic properties actually obtained.

In view of this, the present inventors have found out that the heat treatment condition of the magnetic core can be easily optimized by forming a hole for measuring the internal temperature of the magnetic core, such that the hole passes through from the one end face in the width direction of the thin strips as a starting point, and this width direction is corresponding to the depth direction of the hole, with respect to the layered body (magnetic core) obtained by layering amorphous alloy thin strips one on another.

Meanwhile, it is concerned that a crushed powder of the amorphous alloy is generated in the course of forming the hole on the layered body. It is concerned that insulation deterioration of the transformer is caused when this crushed powder is released from the layered body.

In view of this, the present inventors have investigated to block the hole with a resin layer for covering the end face (end face in the width direction of the thin strips) of the layered body.

However, it was demonstrated that it is difficult to block the hole with a resin layer to be used for covering the end face of the layered body in some cases.

In view of this, the present inventors have carried out investigations on the kind of resin for the resin layer by giving priority to blocking of the hole.

However, it was demonstrated that the flatness of the surface of the resin layer is impaired by the resin layer using a resin capable of blocking the hole in some cases.

The invention has been made in view of the above circumstances, and it aims to achieve the following object.

That is, an object of the invention is to provide a method of manufacturing an amorphous alloy magnetic core capable of blocking a hole with a resin layer while maintaining high flatness of the surface of the resin layer upon manufacturing a magnetic core including a layered body obtained by layering amorphous alloy thin strips one on another, a hole for measurement of heat treatment temperature passing through from the one end face of the layered body as the starting point, and a resin layer to cover at least a part of one end face.

Solution to Problem

Specific means for achieving the above object is as follows.

<1> A method of manufacturing an amorphous alloy magnetic core, the method including:

a layered body preparing step of preparing a layered body by layering amorphous alloy thin strips one on another, the layered body having one end face and another end face in a width direction of the amorphous alloy thin strips and an inner peripheral surface and an outer peripheral surface orthogonal to a layering direction of the amorphous alloy thin strips;

a hole forming step of forming a hole passing through from the one end face of the layered body as a starting point, the width direction corresponding to a depth direction of the hole;

a heat treatment step of subjecting the layered body, after being subjected to the hole forming step, to a heat treatment while measuring an internal temperature of the hole; and a resin layer forming step of forming a resin layer which blocks the hole and covers at least a part of the one end face by coating and curing a two-liquid mixed type epoxy resin composition having a viscosity (25° C.) after mixing of two liquids measured under a condition of a rotation speed of 50 rpm of from 38 Pa·s to 51 Pa·s and a thixotropy index value (25° C.) after mixing of the two liquids determined by the following Formula (1) of from 1.6 to 2.7 on a region which is at least a part of at least the one end face of the layered body after being subjected to the heat treatment step and includes the hole:

Thixotropy index value (25° C.) after mixing of two liquids=viscosity at 5 rpm/viscosity at 50 rpm Formula (1)

wherein, in Formula (1), the term "viscosity at 50 rpm" refers to the viscosity (25° C.) after mixing of the two liquids of the two-liquid mixed type epoxy resin composition measured under the condition of a rotation speed of 50 rpm and the term "viscosity at 5 rpm" refers to the viscosity (25° C.) after mixing of the two liquids of the two-liquid mixed type epoxy resin composition measured under the condition of a rotation speed of 5 rpm.

<2> The method of manufacturing an amorphous alloy magnetic core according to <1>, wherein the heat treatment is conducted on the layered body, which is disposed in a magnetic field in the heat treatment step.

<3> The method of manufacturing an amorphous alloy magnetic core according to <1> or <2>, wherein the layered body after being subjected to the hole forming step but before being subjected to the resin layer forming step is configured such that a shortest distance between a center of the hole and a center line in a thickness direction of the layered body is 10% or less with respect to a thickness of the layered body, when viewed from a side of the one end face in the layered body.

<4> The method of manufacturing an amorphous alloy magnetic core according to any one of <1> to <3>, wherein the layered body after being subjected to the hole forming step but before being subjected to the resin layer forming step is configured such that the entire hole is included in a range from one end to another end in a longitudinal direction of the inner peripheral surface on the one end face, when viewed from a side of the one end face in the layered body.

<5> The method of manufacturing an amorphous alloy magnetic core according to any one of <1> to <4>, wherein the layered body after being subjected to the hole forming step but before being subjected to the resin layer forming step is configured such that a shortest distance between a center of the hole and a center line in a longitudinal direction of the layered body is 20% or less with respect to a length in the longitudinal direction of the layered body, when viewed from a side of the one end face in the layered body.

<6> The method of manufacturing an amorphous alloy magnetic core according to any one of <1> to <5>, wherein the layered body after being subjected to the hole forming step but before being subjected to the resin layer forming step is configured such that a depth of the hole is from 30% to 70% with respect to a distance between the one end face and the another end face in the layered body.

<7> The method of manufacturing an amorphous alloy magnetic core according to any one of <1> to <6>, wherein the layered body after being subjected to the hole forming step but before being subjected to the resin layer forming step is configured such that a width of the hole is 1.5 mm or more in the layered body.

<8> The method of manufacturing an amorphous alloy magnetic core according to any one of <1> to <7>, wherein the layered body after being subjected to the hole forming step but before being subjected to the resin layer forming step is configured such that a width of the hole is narrower than a value to be calculated by a mathematical formula $T\times(100-LF)/100$, wherein a thickness (mm) of the layered body is denoted as T and a space factor (%) of the amorphous alloy magnetic core is denoted as LF in the layered body.

<9> The method of manufacturing an amorphous alloy magnetic core according to any one of <1> to <8>, wherein the layered body after being subjected to the hole forming step but before being subjected to the resin layer forming step is configured such that a width of the hole is 3.5 mm or less in the layered body.

<10> The method of manufacturing an amorphous alloy magnetic core according to any one of <1> to <9>, wherein the layered body after being subjected to the hole forming step but before being subjected to the resin layer forming step is configured such that a length of the hole is from 1.5 mm to 35 mm in the layered body.

Advantageous Effects of Invention

According to the invention, a method of manufacturing an amorphous alloy magnetic core capable of blocking a hole with a resin layer while maintaining high flatness of the surface of the resin layer upon manufacturing a magnetic core including a layered body obtained by layering amorphous alloy thin strips one on another, a hole for measurement of heat treatment temperature passing through from the one end face of the layered body as the starting point, and a resin layer to cover at least a part of the one end face is provided.

DESCRIPTION OF EMBODIMENTS

Figure 1:
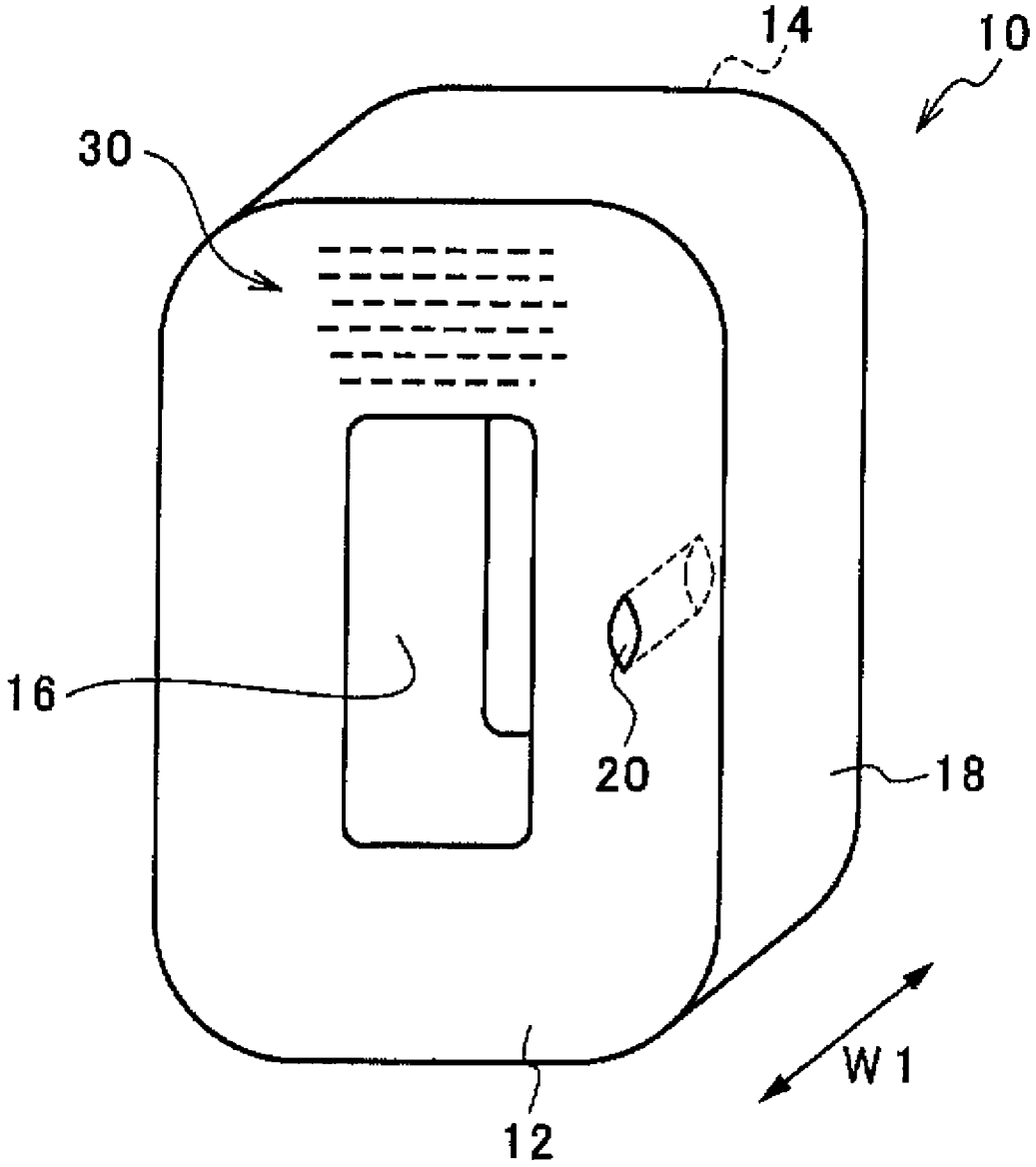
FIG. 1 is a schematic perspective view of a layered body after being subjected to a hole forming step but before being subjected to a resin layer forming step in a first embodiment.

Hereinafter, the method of manufacturing an amorphous alloy magnetic core (hereinafter, also simply referred to as the "magnetic core" or "core") of the invention (hereinafter, also referred to as the "manufacturing method of the invention") will be described in detail.

In the present specification, the numerical range indicated by using "to" means a range including the numerical values described before and after "to" as the minimum value and the maximum value, respectively.

In the present specification, the unit "rpm" is an abbreviation for round per minute.

In the present specification, the term "step" includes not only an independent step but also a step by which the intended purpose of the step is achieved although it is not clearly distinguished from other steps.

The method of manufacturing an amorphous alloy magnetic of the invention includes a layered body preparing step of preparing a layered body by layering amorphous alloy thin strips (hereinafter, simply referred to as the "thin strips" or "ribbons") one on another, the layered body having one end face and another end face in a width direction of the amorphous alloy thin strips and an inner peripheral surface and an outer peripheral surface orthogonal to a layering direction of the amorphous alloy thin strips, a hole forming step of forming a hole passing through from the one end face of the layered body as a starting point, the width direction corresponding to a depth direction of the hole, a heat treatment step of subjecting the layered body after being subjected to the hole forming step to a heat treatment while measuring an internal temperature of the hole, and a resin layer forming step of forming a resin layer which blocks the hole and covers at least a part of the one end face by coating and curing a two-liquid mixed type epoxy resin composition having a viscosity (25° C.) after mixing of two liquids measured under a condition of a rotation speed of 50 rpm (hereinafter also referred to as the "viscosity at 50 rpm" or simply "viscosity") of from 38 Pa·s to 51 Pa·s and a thixotropy index value (25° C.) after mixing of the two liquids (hereinafter, also referred to as the "T. I. value") determined by the following Formula (1) of from 1.6 to 2.7 on a region which is at least a part of at least the one end face of the layered body after being subjected to the heat treatment step and includes the hole. The manufacturing method of the invention may include other steps if necessary.

Thixotropy index value (25° C.) after mixing of two liquids=viscosity at 5 rpm/viscosity at 50 rpm Formula (1)

wherein, in Formula (1), the term "viscosity at 50 rpm" refers to the viscosity (25° C.) after mixing of the two liquids of the two-liquid mixed type epoxy resin composition measured under the condition of a rotation speed of 50 rpm and the term "viscosity at 5 rpm" refers to the viscosity (25° C.) after mixing of the two liquids of the two-liquid mixed type epoxy resin composition measured under the condition of a rotation speed of 5 rpm.

There has been a problem in the conventional amorphous alloy magnetic core that it is difficult or cumbersome to optimize the heat treatment condition for imparting magnetic properties. The reason for this is the internal temperature profile of the magnetic core is not often consistent with the surface temperature profile of the magnetic core during the heat treatment. Hence, the final heat treatment condition has been hitherto often determined by repeating the adjustment of the heat treatment condition while confirming the relation between the heat treatment condition and the magnetic properties actually obtained.

With regard to the above problem, the manufacturing method of the invention includes a hole forming step of forming a hole for measuring a temperature on the layered body constituting a part of the magnetic core. This makes it possible to accurately measure the internal temperature profile of the hole, namely, the internal temperature profile of the magnetic core during the heat treatment for imparting magnetic properties by inserting a temperature measuring unit (hereinafter, also referred to as the "thermocouple or the like") such as a thermocouple or a temperature sensor into the hole. Moreover, it is possible to easily adjust (optimize) the heat treatment condition while confirming the internal temperature profile of the magnetic core.

Consequently, according to the manufacturing method of the invention, it is possible to easily optimize the heat treatment condition of the layered body.

According to the manufacturing method of the invention, it is possible to easily adjust (optimize) the heat treatment condition while confirming the internal temperature profile of the individual cores, for example, even in the case of deciding the common heat treatment condition for magnetic cores having different sizes or in the case of deciding the heat treatment condition for conducting the heat treatment of a plurality of magnetic cores in the same heat treating furnace.

As described above, the present inventors have found out that it is possible to easily optimize the heat treatment condition for the magnetic core by forming the hole on the layered body (magnetic core) obtained by layering amorphous alloy thin strips one on another.

Meanwhile, it is concerned that a crushed powder of the amorphous alloy is generated in the course of forming the hole on the layered body. It is concerned that insulation deterioration of the transformer is caused when this crushed powder is released from the layered body.

In addition, distortion newly occurs and the magnetic properties deteriorate when it is attempted to block the hole by deforming the layered body after the heat treatment. Hence, it is preferable that the hole on the layered body be left as a hole even after the heat treatment.

In view of this, the present inventors have investigated to block the hole with a resin layer for covering the end face (end face in the width direction of the thin strips) of the layered body.

However, it was demonstrated that it is difficult to block the hole with a general resin layer to be used for covering the end face of the layered body in some cases.

In view of this, the present inventors have carried out investigations on the kind of resin for the resin layer by giving priority to blocking of the hole.

However, it was demonstrated that the flatness of the surface of the resin layer is impaired by the resin layer using a resin capable of blocking the hole in some cases.

For example, in the case of forming a resin layer by coating a resin composition on the end face of a layered body by using a coating member (for example, a spatula or a brush-like coating member), irregularities due to contact with the coating member remain on the surface of the resin layer and the flatness of the surface of the resin layer drops in some cases.

With regard to the problem described above, according to the manufacturing method of the invention, it is possible to achieve both the blocking property (hereinafter, also referred to as the "hole blocking property of the resin layer" and "hole blocking property") to block the hole with the resin layer and the flatness of the surface of the resin layer by forming a resin layer by using a two-liquid mixed type epoxy resin composition having a viscosity and a T. I. value in the above ranges.

Specifically, in the invention, the hole blocking property of the resin layer is improved as the viscosity (viscosity at 50 rpm) is 38 Pa·s or more. It is difficult to block the hole with the resin layer when the viscosity is less than 38 Pa·s.

Furthermore, in the invention, the hole blocking property of the resin layer is improved as the T. I. value is 1.6 or more.

When the T. I. value is less than 1.6, the viscosity after coating which corresponds to the viscosity at 5 rpm does not increase that much as compared to the viscosity during coating which corresponds to the viscosity at 50 rpm, and thus the resin is likely to enter the hole due to its own weight or the like and the hole blocking property tends to decrease.

Furthermore, in the invention, it is possible to maintain the flatness of the resin layer high as the T. I. value is 2.7 or less.

The flatness of the surface of the resin layer is impaired when the T. I. value exceeds 2.7.

Furthermore, in the invention, it is possible to obtain an effect that the flatness of the resin layer can be maintained high and an effect that it is easy to coat the resin composition as the viscosity is 51 Pa·s or less.

In the invention, the viscosity (25° C.) after mixing of two liquids measured under a condition of a rotation speed of 50 rpm refers to the viscosity measured under a condition of a rotation speed of the rotator (rotation speed of the spindle) of 50 rpm and a temperature of the epoxy resin composition after mixing of the two liquids of 25° C. by using a B type viscometer and a rotor (spindle) having a rotor No. 7 (spindle number: 7) in conformity to JIS K 7117-1 (1999).

In addition, in the invention, the viscosity at 5 rpm refers to the viscosity measured in the same manner as the viscosity at 50 rpm except that the rotation speed of the rotator (rotation speed of the spindle) is changed to 5 rpm.

Incidentally, in the present specification, the unit "rpm" (round per minute) is synonymous with "$min^{-1}$".

In the invention, the viscosity (viscosity at 50 rpm) is particularly preferably 40 Pa·s or more.

In the invention, the viscosity (viscosity at 50 rpm) is particularly preferably 45 Pa·s or less.

In the invention, the T. I. value is particularly preferably 1.8 or more.

In the invention, the T. I. value is particularly preferably 2.5 or less.

Incidentally, it is sufficient that the resin layer blocks the entrance (opening) of the hole. Scattering of the crushed powder is suppressed when the resin layer blocks the entrance of the hole. That is, the entire hole (the total volume of the hole) is not necessarily filled with the resin.

A preferred aspect of the manufacturing method of the invention is an aspect in which a temperature measuring unit is inserted into the hole after the hole forming step but before the heat treatment step, the internal temperature of the hole is measured by the temperature measuring unit in the heat treatment step, and the temperature measuring unit is removed (taken out) from the hole after the heat treatment step but before the resin layer forming step.

The temperature measuring unit is not particularly limited as long as it can measure the internal temperature of the hole during the heat treatment of the layered body, but examples thereof may include a thermocouple and a temperature sensor.

As a thermocouple, a sheath type thermocouple is suitable.

The diameter of the temperature measuring unit can be appropriately selected in consideration of the width of the hole.

In the manufacturing method of the invention, it is preferable that the heat treatment is conducted on the layered body, which is disposed in a magnetic field in the heat treatment step. This makes it easy to impart desired magnetic properties to the magnetic core to be manufactured.

The hole in the manufacturing method of the invention is preferably provided at a position at which the temperature is greatly different from that of the surface of the layered body. The position at which the temperature is greatly different from that of the surface of the layered body can be determined, for example, by simulation taking thermal conduction into consideration.

Hereinafter, a preferred aspect of the position of the hole will be described.

In the manufacturing method of the invention, it is preferable that the layered body after being subjected to the hole forming step but before being subjected to the resin layer forming step is configured such that a shortest distance between a center of the hole and a center line (for example, the center line C1 in FIG. 2) in a thickness direction of the layered body is 10% or less with respect to a thickness of the layered body, when viewed from a side of the one end face in the layered body.

In short, it is preferable to form the hole at the center in the thickness direction of the layered body or in the vicinity thereof.

This makes it possible to measure the temperature of a place at which the temperature is greatly different from that of the surface (for example, the outer peripheral surface and the inner peripheral surface to be described later) of the layered body in the interior of the layered body, and it is thus easier to optimize the heat treatment condition.

In the present specification, the thickness direction of the layered body refers to the thickness direction of the thin strips; in other words, the layering direction of the thin strips.

Figure 2:
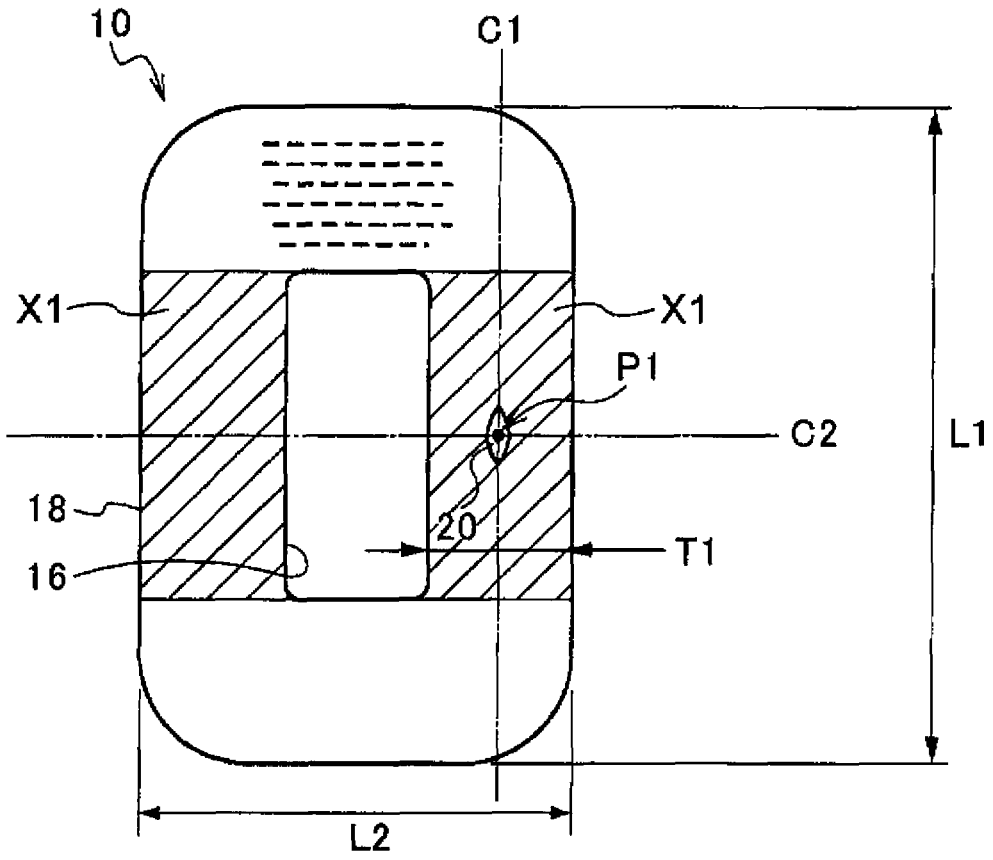
FIG. 2 is a schematic plan view of a layered body after being subjected to a hole forming step but before being subjected to a resin layer forming step in a first embodiment.

That is, the thickness of the layered body refers to the total thickness of the layered thin strips (layered thickness of the thin strips) (for example, the thickness T1 in FIG. 2).

In addition, it is preferable that the layered body after being subjected to the hole forming step but before being subjected to the resin layer forming step is configured such that the entire hole is included in a range (for example, the range X1 indicated by an oblique line in FIG. 2) from one end to another end in a longitudinal direction of the inner peripheral surface on the one end face, when viewed from a side of the one end face in the layered body.

Here, the "range from one end to another end in a longitudinal direction of the inner peripheral surface on the one end face" refers to the range from a straight line which passes through one end in the longitudinal direction of the inner peripheral surface and is orthogonal to this longitudinal direction to a straight which passes another end in the longitudinal direction of the inner peripheral surface and is orthogonal to this longitudinal direction on the one end face.

In addition, it is also preferable that the layered body after being subjected to the hole forming step but before being subjected to the resin layer forming step is configured such that a shortest distance between a center of the hole and a center line (for example, the center line C2 in FIG. 2) in a longitudinal direction of the layered body is 20% or less (more preferably 10% or less and still more preferably 5% or less) with respect to a length (for example, the long side length L1 in FIG. 2) in the longitudinal direction of the layered body, when viewed from a side of the one end face in the layered body.

In addition, in the manufacturing method of the invention, it is preferable that the layered body after being subjected to the hole forming step but before being subjected to the resin layer forming step is configured such that a depth (for example, the depth Dh in FIG. 4) of the hole is from 30% to 70% with respect to a distance (for example, the distance D1 in FIG. 4) between the one end face and the another end face in the layered body.

In short, it is preferable that the bottom of the hole exist at the midpoint between the one end face and the another end face or in the vicinity thereof.

This makes it possible to measure the temperature of a place at which the temperature is greatly different from that of the surface (specifically one end face and another end face) of the layered body in the interior of the layered body and it is thus easier to optimize the heat treatment condition.

In addition, in the manufacturing method of the invention, it is preferable that the layered body after being subjected to the hole forming step but before being subjected to the resin layer forming step is configured such that a width of the hole is 1.5 mm or more in the layered body.

This makes it easier to insert a thermocouple or the like into the hole. Furthermore, it is possible to further decrease the friction when the thermocouple or the like is taken out from the hole.

Figure 3:
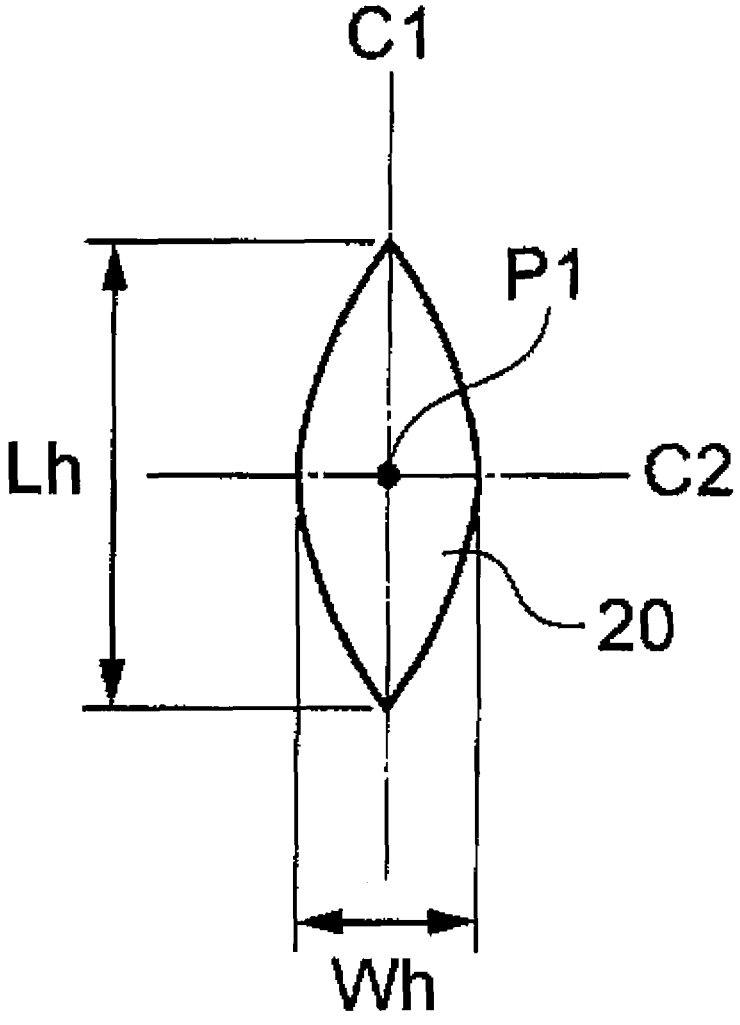
FIG. 3 is a partially enlarged view of FIG. 2.

Incidentally, in the present specification, the width of the hole means the maximum width of the hole (the maximum value of the length in the width direction of the hole; for example, the width Wh in FIG. 3) when viewed from the side of the one end face.

In the layered body, the width of the hole preferably corresponds to the length in the thickness direction of the layered body of the hole (for example, see FIG. 2).

In addition, in the manufacturing method of the invention, it is preferable that the layered body after being subjected to the hole forming step but before being subjected to the resin layer forming step is configured such that a width of the hole is narrower than a value to be calculated by a mathematical formula $T\times(100-LF)/100$, wherein a thickness (mm) of the layered body is denoted as T and a space factor (%) of the amorphous alloy magnetic core is denoted as LF in the layered body.

The value to be calculated by the mathematical formula $T\times(100-LF)/100$ is the sum of the widths of the gaps between the thin strips included between the inner peripheral surface and the outer peripheral surface.

The volume of deformation of the outer shape (the outer peripheral surface and the inner peripheral surface, the same applies hereinafter) of the layered body caused by providing the hole can be absorbed by the gap between the thin strips as the width of the hole is narrower than the value to be calculated by the mathematical formula $T\times(100-LF)/100$. Hence, it is possible to suppress deformation of the outer shape of the layered body caused by providing the hole.

The width of the hole is preferably less than the value to be calculated by a mathematical formula $(T\times(100-LF)/100)/2$ from the viewpoint of further suppressing the deformation of the outer shape of the layered body caused by providing the hole.

In addition, in the manufacturing method of the invention, it is preferable that the layered body after being subjected to the hole forming step but before being subjected to the resin layer forming step is configured such that a width of the hole is 3.5 mm or less and more preferably 3.0 mm or less in the layered body.

It is possible to suppress deformation of the outer shape of the layered body caused by providing the hole as the width of the hole is 3.5 mm or less.

The width of the hole is still more preferably from 1.5 mm to 3.5 mm, still more preferably from 1.5 mm to 3.0 mm, and particularly preferably from 2.0 mm to 3.0 mm.

In addition, in the manufacturing method of the invention, it is preferable that the layered body after being subjected to the hole forming step but before being subjected to the resin layer forming step is configured such that a length of the hole is from 1.5 mm to 35 mm in the layered body.

It is easier to insert a thermocouple or the like into the hole when the length of the hole is 1.5 mm or more. Furthermore, it is possible to further decrease the friction when the thermocouple or the like is taken out from the hole.

Meanwhile, it is possible to further suppress a decrease in magnetic properties of the magnetic core caused by providing the hole when the length of the hole is 35 mm or less.

The length of the hole is more preferably from 5 mm to 35 mm and particularly preferably from 10 mm to 30 mm.

Incidentally, in the present specification, the length of the hole means the maximum length of the hole (the maximum value of the length in the longitudinal direction of the hole; for example, the length Lh in FIG. 3) when viewed from the side of one end face.

In addition, in the present specification, the length of the hole and the width of the hole satisfy the relation that the length of the hole≥the width of the hole although it is needless to say.

In addition, in the manufacturing method of the invention, the thickness of the layered body (layered thickness of the thin strips) is preferably from 10 mm to 300 mm and more preferably from 10 mm to 200 mm.

In addition, in the manufacturing method of the invention, the space factor of the layered body is preferably 85% or more. The upper limit of the space factor of the layered body is ideally 100%, but the upper limit may be 95% or 90%.

Here, the space factor (%) refers to the value determined based on the thickness of the thin strips, the number of thin strips layered, and the thickness of the layered body (for example, the thickness T1 in FIG. 2).

Hereinafter, the respective steps in the manufacturing method of the invention will be described.

<Layered Body Preparing Step>

The layered body preparing step is a step of preparing a layered body by layering thin strips one on another, the layered body having one end face and another end face in a width direction of the thin strips and an inner peripheral surface and an outer peripheral surface orthogonal to a layering direction of the thin strips.

The layered body to be prepared in the present step is a main constituent member of the amorphous alloy magnetic core manufactured by the manufacturing method of the invention.

The present step is a convenient step and may be a step of manufacturing a layered body or a step of simply preparing a layered body which has been already manufactured.

In addition, the layered body preparing step may be a step of preparing a composite equipped with a silicon steel plate in contact with the inner peripheral surface (hereinafter, referred to as the "inner peripheral surface side silicon steel plate") on the further inner side of the inner peripheral surface (namely, the inner peripheral surface of the innermost peripheral thin strips) of the layered body.

The composite equipped with the inner peripheral surface side silicon steel plate has advantages of being able to improve the strength of the magnetic core, being easy to maintain the shape of the magnetic core, and the like.

In addition, the layered body preparing step may be a step of preparing a composite equipped with a silicon steel plate in contact with the outer peripheral surface (hereinafter, referred to as the "outer peripheral surface side silicon steel plate") on the further outer side of the outer peripheral surface (namely, the outer peripheral surface of the outermost peripheral thin strip) of the layered body.

The composite equipped with the outer peripheral surface side silicon steel plate has advantages of being able to improve the strength of the magnetic core, being easy to maintain the shape of the magnetic core, and the like.

In addition, the layered body preparing step may be a step of preparing a composite equipped with the layered body, the inner peripheral surface side silicon steel plate, and the outer peripheral surface side silicon steel plate.

The inner peripheral surface side silicon steel plate and the outer peripheral surface side silicon steel plate may be a nondirectional silicon steel plate or a directional silicon steel plate, respectively.

The thicknesses of the inner peripheral surface side silicon steel plate and the outer peripheral surface side silicon steel plate are not particularly limited, and the thickness of a general silicon steel plate may be mentioned. The thicknesses of the inner peripheral surface side silicon steel plate and the outer peripheral surface side silicon steel plate are preferably from 0.2 mm to 0.4 mm, respectively.

As a method of manufacturing the layered body and a method of manufacturing a composite equipped with the layered body and at least either of the inner peripheral surface side silicon steel plate or the outer peripheral surface side silicon steel plate, a known method of manufacturing an amorphous alloy magnetic core can be applied.

Incidentally, for the method of manufacturing an amorphous alloy magnetic core and the structure of an amorphous alloy magnetic core, for example, it is possible to see "Characteristics and magnetic properties of amorphous core for energy-saving transformer" (internet <URL: http://www.hitachi-metals.co.jp/products/infr/en/pdf/hj-b13-a.pdf).

A preferred aspect of the manufacturing method of the invention is an aspect in which a composite (for example, the second composite in Examples) equipped with the layered body (for example, a layered body 10 to be described later or a layered body 100 to be described later), the inner peripheral surface side silicon steel plate, and the outer peripheral surface side silicon steel plate is prepared in the layered body preparing step and a hole is formed on the layered body portion of this composite.

<Hole Forming Step>

The hole forming step is a step of forming a hole passing through from the one end face (one end face in the width direction of the thin strips) of the layered body as a starting point, the width direction (width direction of the thin strips) corresponding to a depth direction of the hole.

The hole is provided for measuring the internal temperature of the layered body in the heat treatment step to be described later. By forming the hole on the layered body, it is possible to conduct the heat treatment of the layered body while measuring the internal temperature of the hole (namely, the internal temperature of the layered body) and it is thus easy to optimize the heat treatment condition.

The method of forming the hole is not particularly limited, but a method of forming a hole by a method to insert a bar-like member from one end face of the layered body is preferable from the viewpoint of decreasing the influence on the magnetic properties of the magnetic core. In this method, a hole is formed as the interval between a thin strip and another thin strip is partially expanded by the bar-like member inserted.

As the shape of the bar-like member, a bar shape having a pointed tip portion is preferable. In this aspect, the bar-like member can be inserted into one end face of the layered body from the pointed tip portion side, and it is thus easy to expand a part between the thin strips (that is, it is easy to form a hole).

As the material for the bar-like member, a highly rigid material is preferable, and examples thereof may include a metal and ceramics.

The diameter of the bar-like member can be appropriately selected in consideration of the size of the hole to be formed, for example, a diameter of from 3 mm to 7 mm may be mentioned.

Hereinafter, the layered body after being subjected to the hole forming step but before being subjected to the resin layer forming step (namely, the magnetic core before being subjected to formation of the resin layer) in the embodiments of the invention will be described with reference to the drawings, but the invention is not limited to the following embodiments. In addition, the same reference numerals may be attached to elements common to the respective drawings, and redundant explanation may be omitted.

(First Embodiment)

The layered body in the first embodiment is an example of a layered body constituting a part of a magnetic core called "single-phase core" (or "single-phase bipod core").

Figure 4:
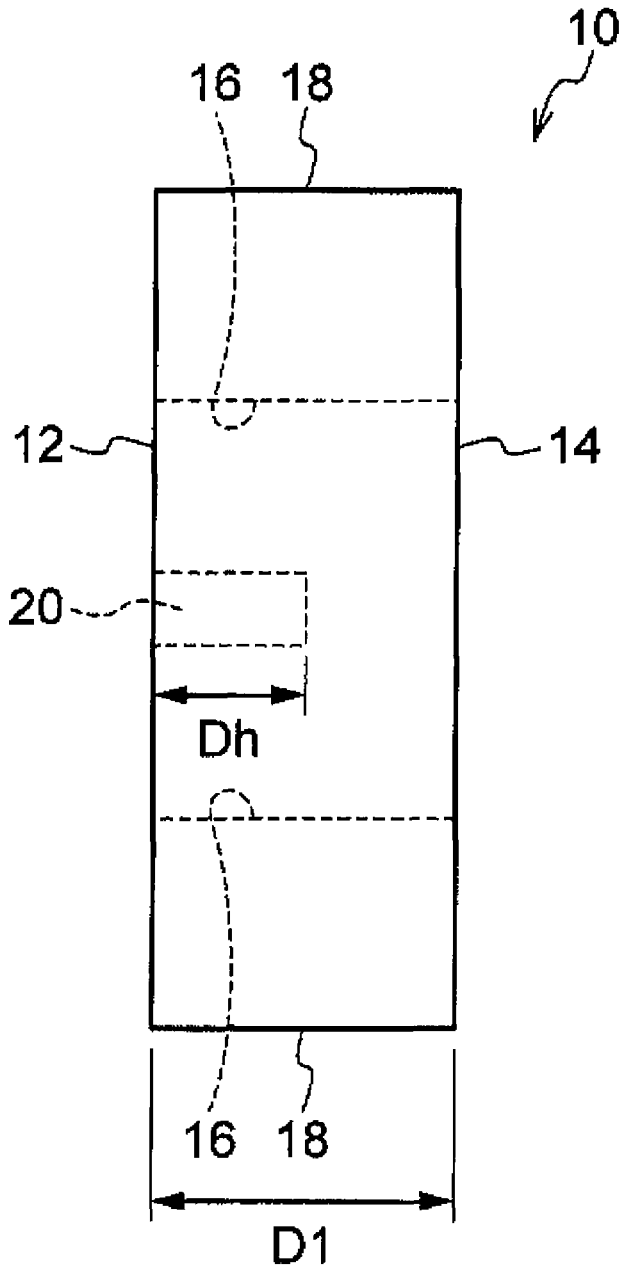
FIG. 4 is a schematic side view of a layered body after being subjected to a hole forming step but before being subjected to a resin layer forming step in a first embodiment.

FIG. 1 is a schematic perspective view of the layered body after being subjected to the hole forming step but before being subjected to the resin layer forming step in the first embodiment of the invention, FIG. 2 is a schematic plan view of the layered body after being subjected to the hole forming step but before being subjected to the resin layer forming step in the first embodiment, and FIG. 4 is a schematic side view of the layered body after being subjected to the hole forming step but before being subjected to the resin layer forming step in the first embodiment.

As illustrated in FIG. 1 and FIG. 4, a layered body 10 of the layered body after being subjected to the hole forming step but before being subjected to the resin layer forming step is formed by layering amorphous alloy thin strips (the layered structure is not illustrated) one on another, and it is a layered body in a rectangular annular shape (tubular shape) having one end face 12 and another end face 14 which are in the width direction W1 of the amorphous alloy thin strips and an inner peripheral surface 16 and an outer peripheral surface 18 which are orthogonal to the layering direction of the amorphous alloy thin strips. In the layered body 10, the overlap portion 30 is a portion at which both end portions in the longitudinal direction of the individual thin strips overlap each other.

Incidentally, the "rectangle" referred to here is not limited to a shape in which the four corners are not rounded and includes a shape in which the four corners are rounded (having a radius of curvature) as the layered body 10.

In addition, the shape of the layered body in the invention is not limited to a rectangular annular shape (tubular shape), and it may be an elliptical (including circular) annular shape (tubular shape).

A hole 20 which passes through from a part of the one end face 12 as the starting point and the width direction W1 corresponds to the depth direction of the hole is formed on the layered body 10.

By conducting the heat treatment of the layered body 10 in a state in which a thermocouple or the like is inserted in the hole 20, it is possible to accurately measure the internal temperature profile of the hole 20 (namely, the internal temperature profile of the layered body) in the course of the heat treatment. This makes it possible to easily optimize the heat treatment condition.

FIG. 3 is a partially enlarged view of FIG. 2, and it is a view illustrating the enlarged hole 20.

As illustrated in FIG. 2 and FIG. 3, the shape of the hole 20 is a shape which has the longitudinal direction of the thin strips as the longitudinal direction, of which the central portion in the longitudinal direction is swollen, and both end portions in the longitudinal direction are pointed. However, the shape of the hole of the invention is not limited to the shape of the hole 20, and it may be any shape such as an elliptical shape (including a circular shape), a rhombus shape, or a rectangular shape.

In addition, as illustrated in FIG. 2 and FIG. 3, in the layered body 10, the hole 20 is provided on the center line C1 in the thickness direction (the direction of the thickness T1) of the layered body.

The position on the center line C1 is a position farthest from the outer peripheral surface 18 and inner peripheral surface 16 of the layered body 10 and a place at which the temperature is greatly different from those of the outer peripheral surface 18 and the inner peripheral surface 16. It is particularly effective to provide the hole 20 at this position in order to measure the internal temperature of the layered body 10. By providing the hole 20 at this position, it is possible to accurately measure the internal temperature profile of the layered body 10 in the course of the heat treatment. This makes it easier to optimize the heat treatment condition.

However, the hole 20 is not necessarily provided on the center line C1. For example, it is possible to obtain approximately the same effect as in the case of providing the hole 20 on the center line C1 when the shortest distance between the center P1 of the hole 20 and the center line C1 is 10% or less (preferably 5% or less) with respect to the thickness T1 of the layered body.

In addition, as illustrated in FIG. 2 and FIG. 3, in the layered body 10, the hole 20 is provided on the center line C2 in the longitudinal direction of the layered body 10.

The position on the center line C2 is a position farthest from both ends in the longitudinal direction of the layered body 10, and a place at which the temperature is greatly different from those of these both ends. It is also particularly effective to provide the hole 20 at this position in order to measure the internal temperature of the layered body 10 (namely, the internal temperature of the magnetic core). By providing the hole 20 at this position, it is possible to accurately measure the internal temperature profile of the layered body 10 (namely, the internal temperature profile of the magnetic core) in the course of the heat treatment. This makes it easier to optimize the heat treatment condition.

Incidentally, the hole 20 is not necessarily provided on the center line C2, but it is preferable that the entire hole 20 be included in a range (a range X1 indicated by an oblique line in FIG. 2) from one end to another end in the longitudinal direction of the inner peripheral surface 16 on the one end face 12 when viewed from the side of the one end face 12. In addition, the shortest distance between the center P1 of the hole 20 and the center line C2 is 20% or less (more preferably 10% or less and still more preferably 5% or less) with respect to the long side length L1 (length in the longitudinal direction of the layered body 10) of the layered body 10.

In addition, as illustrated in FIG. 4, the depth Dh of the hole 20 is half (50%) of the distance D1 between one end face 12 and another end face 14 (namely, the width of the thin strip). The position to be 50% of the distance D1 is a position farthest from one end face 12 and the another end face 14 of the layered body 10 and a place at which the temperature is greatly different from those of one end face 12 and another end face 14. It is also particularly effective to set the depth Dh of the hole 20 to this depth in order to measure the internal temperature of the layered body 10 (namely, the internal temperature of the magnetic core). By setting the depth Dh of the hole 20 to this depth, it is possible to accurately measure the internal temperature profile of the layered body 10 (namely, the internal temperature profile of the magnetic core) in the course of the heat treatment. This makes it easier to optimize the heat treatment condition.

However, the depth Dh of the hole 20 is not necessarily 50% of the distance D1. For example, it is possible to obtain approximately the same effect as in the case of setting the depth Dh to be 50% of the distance D1 when the depth Dh of the hole 20 is from 30% to 70% (more preferably from 40% to 60%) of the distance D1.

In addition, the width of the hole 20 (the width Wh of the hole in FIG. 3) viewed from the side of the one end face 12 is not particularly limited, but the width Wh is preferably 1.5 mm or more as described above.

As described above, the width Wh is preferably narrower than the value to be calculated by the mathematical formula $T\times(100-LF)/100$ (more preferably narrower than the value to be calculated by the mathematical formula $(T\times(100-LF)/100)/2$.

Incidentally, T (thickness of the layered body) in these mathematical formulas is the thickness T1 in the first embodiment and the thickness T11 in the second embodiment to be described later.

As described above, the width Wh is preferably 3.5 mm or less and more preferably 3.0 mm or less.

In addition, the length of the hole 20 (the length Lh of the hole in FIG. 3) viewed from the side of the one end face 12 is not particularly limited, but the hole length Lh is preferably from 1.5 mm to 35 mm, more preferably from 5 mm to 35 mm, and particularly preferably from 10 mm to 30 mm as described above.

Incidentally, in the layered body 10, only one hole passing through from the one end face 12 as the starting point is provided, but the layered body in the invention is not limited to this form. In addition, the number of holes in the layered body may be two or more. In the layered body, not only a hole passing through from the one end face as the starting point but also a hole passing through from another end face as the starting point may be provided.

The material for the amorphous alloy thin strip in the layered body 10 is not particularly limited, and a known amorphous alloy such as an Fe-based amorphous alloy, a Ni-based amorphous alloy, or a CoCr-based amorphous alloy can be used.

Examples of the known amorphous alloy may include an Fe-based amorphous alloy, a Ni-based amorphous alloy, and a CoCr-based amorphous alloy which are described in paragraphs 0044 to 0049 of International Publication No. 2013/137117.

As the material for the amorphous alloy thin strip in the invention, an Fe-based amorphous alloy is particularly preferable.

As the Fe-based amorphous alloy, an Fe—Si—B containing amorphous alloy and an Fe—Si—B—C containing amorphous alloy are more preferable.

As the Fe—Si—B containing amorphous alloy, an alloy having a composition in which Si is contained at from 2 atomic % to 13 atomic %, B is contained at from 8 atomic % to 16 atomic %, and Fe and inevitable impurities are contained as the balance is preferable.

In addition, as the Fe—Si—B—C containing amorphous alloy, an alloy having a composition in which Si is contained at from 2 atomic % to 13 atomic %, B is contained at from 8 atomic % to 16 atomic %, C is contained at 3 atomic % or less, and Fe and inevitable impurities are contained as the balance is preferable.

In any cases, a case in which Si is 10 atomic % or less and B is 17 atomic % or less is preferable from the viewpoint of a high saturation magnetic flux density Bs. In addition, in the Fe—Si—B—C containing amorphous alloy thin strip, it is preferable that the amount of C be 0.5 atomic % or less since the secular change is great when C is excessively added.

In addition, the thickness of the amorphous alloy thin strip (the thickness of one thin strip) is preferably from 15 μm to 40 μm, more preferably from 20 μm to 30 μm, and particularly preferably from 23 μm to 27 μm.

It is advantageous that the thickness of the thin strip is 15 μm or more from the viewpoint of being able to maintain the mechanical strength of the thin strip and of increasing the space factor so as to decrease the number of layers in the case of being layered.

In addition, it is advantageous that the thickness of the thin strip is 40 μm or less from the viewpoint of suppressing the eddy current loss low, of being able to decrease the bending strain when being processed into a layered magnetic core, and further of being likely to stably obtain an amorphous phase.

In addition, the width of the amorphous alloy thin strip (the length in the width direction orthogonal to the longitudinal direction of the thin strip) is preferably from 15 mm to 250 mm.

A large-capacity magnetic core is likely to be obtained when the width of the thin strip is 15 mm or more.

In addition, a thin strip exhibiting high plate thickness uniformity in the width direction is likely to be obtained when the width of the thin strip is 250 mm or less.

Among them, the width of the thin strip is more preferably from 50 mm to 220 mm, still more preferably from 100 mm to 220 mm, and still more preferably from 130 mm to 220 mm from the viewpoint of obtaining a large-capacity and practical magnetic core. Among them, the width of the thin strip is particularly preferably 142±1 mm, 170±1 mm, and 213±1 mm of the width of a thin strip that is standardly used.

The manufacture of the amorphous alloy thin strip can be conducted, for example, by a known method such as a liquid quenching method (a single roll method, a twin roll method, a centrifugal method, and the like). Among them, the single roll method is a manufacturing method which requires a relatively simple manufacturing facility and can stably manufacture the amorphous alloy thin strip, and has excellent industrial productivity.

For the method of manufacturing an amorphous alloy thin strip by the single roll method, it is possible to appropriately see, for example, the descriptions of Japanese Patent No. 3494371, Japanese Patent No. 3594123, Japanese Patent No. 4244123, Japanese Patent No. 4529106, and International Publication No. 2013/137117.

The thickness T1 of the layered body 10 is preferably from 10 mm to 300 mm, more preferably from 10 mm to 200 mm, more preferably from 20 mm to 150 mm, and particularly preferably from 40 mm to 100 mm.

The long side length L1 (the length in the longitudinal direction) of the layered body 10 is preferably from 250 mm to 1400 mm and more preferably from 260 mm to 450 mm.

The short side length L2 (the length in the direction orthogonal to the longitudinal direction) of the layered body 10 is preferably from 80 mm to 800 mm and more preferably from 160 mm to 250 mm.

Incidentally, as described above, it is preferable that the inner peripheral surface side silicon steel plate is disposed on the inner peripheral surface side of the layered body 10 and the outer peripheral surface side silicon steel plate is disposed on the outer peripheral surface side of the layered body 10.

(Second Embodiment)

The layered body in the second embodiment of the invention is an example of a layered body constituting a part of a magnetic core called "three-phase core" (or "three-phase tripod core").

Figure 5:
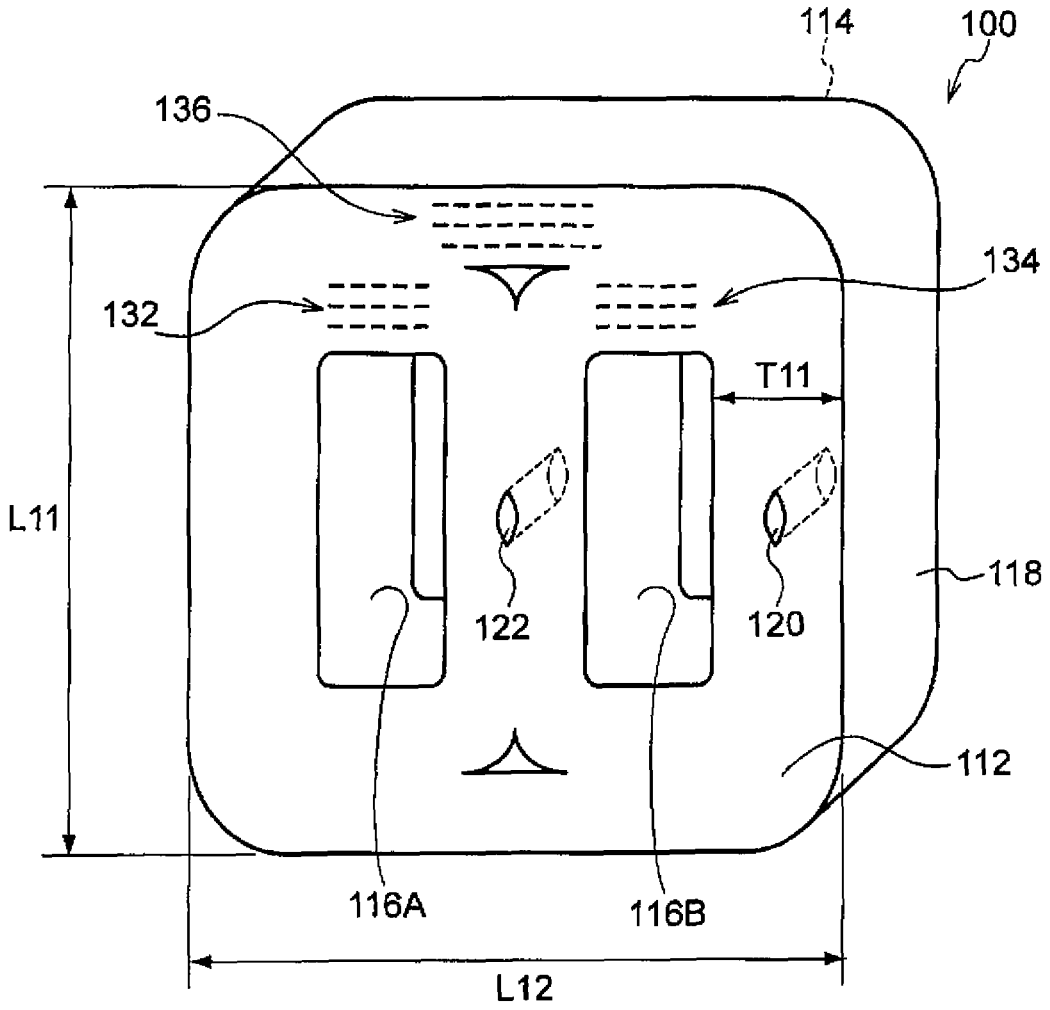
FIG. 5 is a schematic perspective view of a layered body after being subjected to a hole forming step but before being subjected to a resin layer forming step in a second embodiment.

FIG. 5 is a schematic perspective view of the layered body after being subjected to the hole forming step but before being subjected to the resin layer forming step in the second embodiment of the invention.

As illustrated in FIG. 5, a layered body 100 in the second embodiment is also formed by layering amorphous alloy thin strips (layered structure is not illustrated) one on another, and it is a rectangular layered body having one end face 112 and another end face 114 in the width direction of the amorphous alloy thin strips and an outer peripheral surface 118 as the layered body 10.

However, the layered body 100 is different from the layered body 10 in that it has two inner peripheral surfaces (an inner peripheral surface 116A and an inner peripheral surface 116B).

The structure of the layered body 100 is a structure in which two single-phase cores such as the layered body 10 are aligned and surrounded by a bundle of thin strips. The layered body 100 has overlap portions 132 and 134 at the portions of two single-phase cores and an overlap portion 136 at the portion of the bundle of thin strips surrounding the two single-phase cores.

The layered body 100 is also provided with a hole 120 and a hole 122 each of which passes through from a part of the one end face 112 as the starting point, and the width direction of the thin strips corresponds to the depth direction thereof.

By providing these holes, it is possible to easily optimize the heat treatment condition in the same manner as in the case of the layered body 10.

Incidentally, either of the hole 120 or the hole 122 may be omitted.

For preferred aspects (shape, position, depth, size, and the like) of the holes (the holes 120 and 122) in the layered body 100, it is possible to appropriately see the preferred aspects of the layered body 10.

The thickness T11 of the layered body 100 is preferably from 10 mm to 300 mm, more preferably from 10 mm to 200 mm, still more preferably from 20 mm to 200 mm, and particularly preferably from 40 mm to 200 mm.

The length (length L11 and length L12) of one side of the layered body 100 is preferably from 180 mm to 1380 mm and more preferably from 460 mm to 500 mm.

Other preferred aspects and modified examples of the layered body 100 are the same as the preferred aspects and modified examples of the layered body 10.

<Heat Treatment Step>

The heat treatment step is a step of subjecting the layered body after being subjected to the hole forming step to a heat treatment while measuring the internal temperature of the hole. By this heat treatment, magnetic properties are imparted to the layered body.

The measurement of the internal temperature of the hole (namely, the internal temperature of the magnetic core) can be conducted by using a temperature measuring unit such as a thermocouple, a temperature sensor, or the like as described above.

As the thermocouple, a sheath type thermocouple is suitable.

The diameter of the temperature measuring unit can be appropriately selected in consideration of the width of the hole, but for example, it is from 0.5 mm to 3.0 mm and preferably from 1.0 mm to 2.0 mm.

The heat treatment can be conducted by using a known heat treating furnace.

The heat treatment condition can be appropriately set in consideration of the material for the thin strip, the degree of intended magnetic properties, and the like.

Examples of the heat treatment condition may include a condition in which the maximum temperature reached in the hole (namely, in the magnetic core) is in a range of higher than 300° C. and equal to or lower than a temperature tp that is lower by 150° C. than the crystallization starting temperature of the amorphous alloy.

It is easy to remove distortion of the thin strips and to impart excellent magnetic properties to the magnetic core when the maximum reached temperature exceeds 300° C.

It is easy to maintain the amorphous state of the thin strips and to obtain excellent magnetic properties when the maximum reached temperature is equal to or lower than the temperature tp.

In addition, the maximum reached temperature may be higher than 300° C. and equal to or lower than 370° C., or may be equal to or higher than 310° C. and equal to or lower than 370° C.

Here, the crystallization starting temperature of the amorphous alloy is a temperature measured by using a differential scanning calorimeter (DSC) as a heat generation starting temperature when the temperature of the amorphous alloy thin strips is raised under a condition of 20° C./min from room temperature.

In addition, as the heat treatment condition, a condition in which the retention time at the preferred maximum reached temperature described above is from 1 hour to 6 hours is more preferable.

It is possible to suppress variations in magnetic properties among the individual magnetic cores when the retention time in the above state is 1 hour or longer.

It is easy to maintain the amorphous state of the thin strips when the retention time in the above state is 6 hours or shorter.

<Resin Layer Forming Step>

The resin layer forming step is a step of forming a resin layer (epoxy resin layer) which blocks the hole and covers at least a part of the one end face by coating and curing a two-liquid mixed type epoxy resin composition (hereinafter, also referred to as the "specific resin composition") having a viscosity (viscosity at 50 rpm) after mixing of two liquids of from 38 Pa·s to 51 Pa·s and a T. I. value after mixing of the two liquids of from 1.6 to 2.7 on a region which is at least a part of at least the one end face of the layered body after being subjected to the heat treatment step.

The viscosity and the T. I. value in the present step are as described above.

Figure 6:
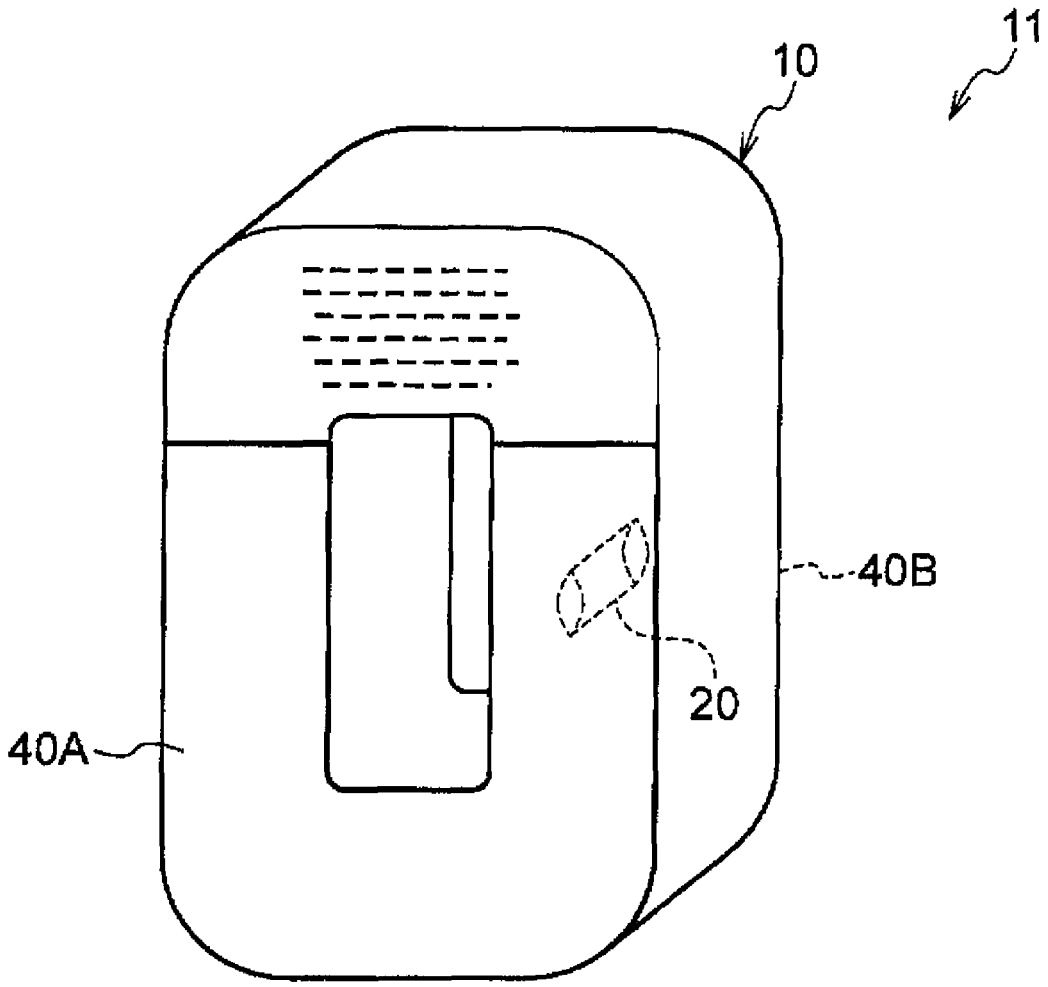
FIG. 6 is a schematic perspective view of a layered body (magnetic core) after being subjected to a resin layer forming step in a first embodiment.
Figure 7:
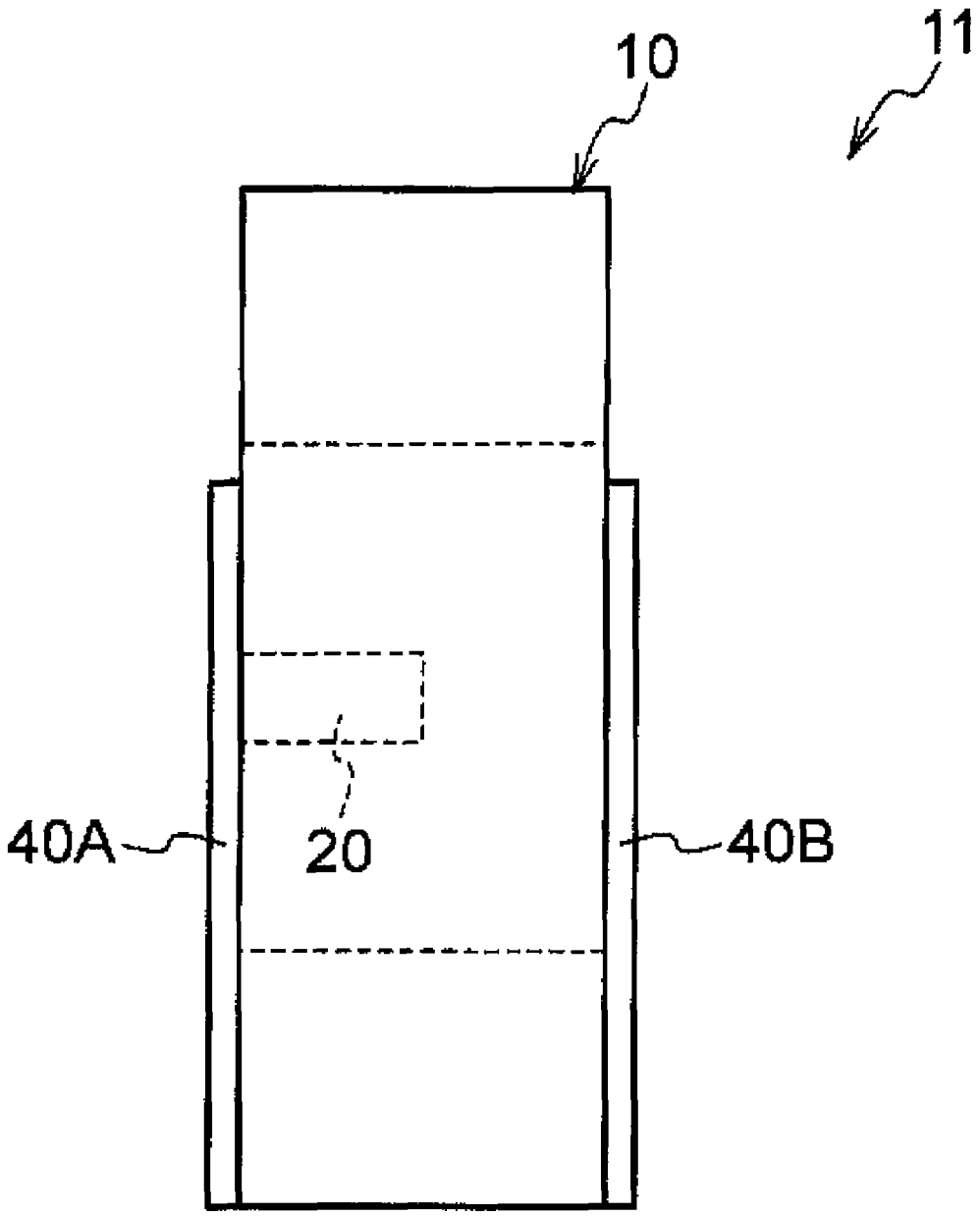
FIG. 7 is a schematic side view of a layered body (magnetic core) after being subjected to a resin layer forming step in a first embodiment.

FIG. 6 is a schematic perspective view of the layered body (magnetic core) after being subjected to the resin layer forming step in the first embodiment, and FIG. 7 is a schematic side view of the layered body (magnetic core) after being subjected to the resin layer forming step in the first embodiment.

As illustrated in FIG. 6 and FIG. 7, in a layered body 11 (magnetic core) after being subjected to formation of the resin layer, a resin layer 40A covering a part of the one end face 12 is formed on the layered body 10 described above. The resin layer 40A blocks the entrance (opening) of the hole 20.

In the layered body 11 (magnetic core) after being subjected to formation of the resin layer in the first embodiment, a resin layer 40B is further formed on a part of another end face 14 of the layered body 10 as well.

The resin layer 40A and the resin layer 40B are layers having a function to protect one end face and another end face of the layered body, and the like. The resin layer 40A and the resin layer 40B are provided at a part of the region other than the overlap portion 30. In this embodiment, the resin layer 40A is formed in a continuous region that is a part of the region other than the overlap portion 30 of the entire region of the one end face of the layered body 10, includes the hole 20, and extends from the outer peripheral surface 18 to the inner peripheral surface 16. In addition, the resin layer 40B is provided in a region overlapping with the resin layer on the side of the one end face, among another end face of the layered body 10, when viewed from the side of the one end face.

However, the resin layer may be provided over the entire one end face and another end face including the overlap portion.

Among the resin layer 40A and the resin layer 40B, the resin layer 40A that blocks the entrance of the hole 20 functions to prevent the broken piece of the thin strips generated by forming the hole 20 from being released from the layered body 10.

Among the resin layer 40A and the resin layer 40B, at least the resin layer 40A is a layer to be formed by using the specific resin composition described above.

The resin layer 40B may also be a layer formed by using the specific resin composition described above, but it may be a layer formed by using a resin composition (preferably a two-liquid mixed type epoxy resin composition) other than the specific resin composition described above.

The specific resin composition is a two-liquid mixed type epoxy resin composition which contains a liquid A containing an epoxy resin and a liquid B containing a curing agent and has a viscosity and a T. I. value within the ranges described above, respectively.

The liquid A contains at least one kind of epoxy resin.

The epoxy resin contained in the liquid A is not particularly limited, but a bisphenol A type liquid epoxy resin (for example, a compound having CAS No. 25068-38-6) and bisphenol A bis(propylene glycol glycidyl ether) ether (for example, a compound having CAS No. 36484-54-5) are preferable.

The content (total content in the case of two or more kinds) of the epoxy resin in the liquid A is preferably from 40 to 95% by mass and more preferably from 50 to 85% by mass with respect to the total amount of the liquid A.

In a case in which the liquid A contains a bisphenol A type liquid epoxy resin, the content of this compound is preferably from 20 to 40% by mass and more preferably from 25 to 35% by mass with respect to the total amount of the liquid A.

In a case in which the liquid A contains bisphenol A bis(propylene glycol glycidyl ether) ether, the content of this compound is preferably from 30 to 55% by mass and more preferably from 35 to 50% by mass with respect to the total amount of the liquid A.

The liquid A may contain components other than the epoxy resin.

Examples of other components may include silica (for example, a compound having CAS No. 14808-60-7).

In a case in which the liquid A contains silica, the content of silica is preferably from 10 to 40% by mass and more preferably from 20 to 35% by mass with respect to the total amount of the liquid A.

In addition, examples of other components may also include a pigment.

In a case in which the liquid A contains a pigment, the content of the pigment is preferably less than 5% by mass with respect to the total amount of the liquid A.

The liquid B contains at least one kind of curing agent.

As the curing agent, an amine compound is preferable, and a modified aliphatic polyamine (for example, a compound having CAS No. 39423-51-3), isophoronediamine (for example, a compound having CAS No. 2855-13-2), and m-xylylenediamine (for example, a compound having CAS No. 1477-55-0) are more preferable.

The content (total content in the case of two or more kinds) of the curing agent in the liquid B is preferably from 80 to 100% by mass and more preferably from 90 to 100% by mass with respect to the total amount of the liquid B.

In a case in which the liquid B contains a modified aliphatic polyamine, the content of the modified aliphatic polyamine is preferably from 70 to 100% by mass and more preferably from 80 to 90% by mass with respect to the total amount of the liquid B.

In a case in which the liquid B contains isophoronediamine, the content of isophoronediamine is preferably from 5 to 25% by mass and more preferably from 10 to 20% by mass with respect to the total amount of the liquid B.

In a case in which the liquid B contains m-xylylenediamine, the content of m-xylylenediamine is preferably less than 5% by mass with respect to the total amount of the liquid B.

The mixing ratio (mass ratio) of the liquid A to the liquid B (liquid A:liquid B) is preferably from 100:10 to 100:40, more preferably from 100:20 to 100:30, particularly preferably from 100:23 to 100:25.

It is likely to be achieved that the viscosity is 38 Pa·s or more and the T. I. value is 1.6 or more when the amount of the liquid B with respect to 100 parts by mass of the liquid A is 10 parts by mass or more.

It is possible to further decrease the heat generation at the time of curing of the resin, to further lower the resin stress after curing, and thus to further improve the magnetic properties of the core when the amount of the liquid B with respect to 100 parts by mass of the liquid A is 40 parts by mass or less.

In the resin layer forming step, the method of coating the specific resin composition is not particularly limited, and a known coating method can be used.

As a method of coating the specific resin composition, for example, a method is suitable in which the specific resin composition is coated on a part of at least one end face of the layered body after being subjected to the heat treatment step by using a coating member such as a brush or a spatula.

In addition, generally in the method of coating a resin composition by using a coating member, there is a case in which irregularities are generated on the surface of the formed resin layer by contact with the coating member and the flatness of the surface of the resin layer thus decreases. However, in the manufacturing method of the invention, the resin layer is formed by using the specific resin composition having a viscosity of 51 Pa·s or less and a T. I. value of 2.7 or less, and it is thus possible to effectively suppress irregularities on the surface of the resin layer and to maintain the flatness of the surface of the resin layer high even in the case of coating the specific resin composition by using a coating member.

In addition, in the resin layer forming step, the method of curing the specific resin composition coated on a part of the layered body is also not particularly limited, and a method known as a method of curing a two-liquid mixed type epoxy resin composition can be applied.

In addition, in the resin layer forming step, a resin layer may also be formed on at least a part of another end face of the layered body in addition to at least a part of one end face of the layered body as described above. In the case of forming a resin layer on another end face, it may be formed by using a specific resin composition or a resin composition other than the specific resin composition. As the resin composition other than the specific resin composition, a two-liquid mixed type epoxy resin composition other than the specific resin composition is preferable.

The manufacturing method of the invention may have steps other than the above steps. Examples of other steps may include a step known as a manufacturing step of an amorphous alloy magnetic core.

EXAMPLES

Hereinafter, Examples of the invention will be described, but the invention is not limited to the following Examples.

Example 1

<Preparation of Amorphous Alloy Thin Strip>

A long amorphous alloy thin strip having a thickness of 25 μm and a width of 170 mm was prepared through continuous roll casting by a single roll method.

The composition of the amorphous alloy thin strip thus prepared is $Fe_{81.7}Si_2B_{16}C_{0.3}$ (the suffix represents atomic % of each element).

<Layered Body Preparing Step>

As the core (magnetic core) before being subjected to the hole forming step, a composite (hereinafter, referred to as a the "second composite") including a rectangular annular layered body which is similar to the layered body 10 described above, an outer peripheral surface side silicon steel plate in contact with the outer peripheral surface of the layered body, and an inner peripheral surface side silicon steel plate in contact with the inner peripheral surface of the layered body was prepared by using the amorphous alloy thin strip. The details will be described below.

First, 30 sheets of the first alloy thin strip obtained by cutting the amorphous alloy thin strip into a length of 700 mm in the longitudinal direction were prepared.

Furthermore, 30 sheets of the second alloy thin strip obtained by cutting the amorphous alloy thin strip so as to have a length in the longitudinal direction that is 5.5 mm longer than the length in the longitudinal direction of the first alloy thin strip were prepared.

In the same manner, 30 sheets of the $(n+1)^{th}$ alloy thin strip obtained by cutting the amorphous alloy thin strip so as to have a length in the longitudinal direction that is 5.5 mm longer than the length in the longitudinal direction of the $n^{th}$ alloy thin strip were prepared, respectively (here, n is an integer from 2 to 84).

Furthermore, a directional silicon steel plate (plate thickness: 0.27 mm, plate width: 170 mm) cut into a length of 1300 mm in the longitudinal direction was prepared.

Next, the first to the 85th alloy thin strips (30 sheets for each) were layered in this order, and the directional silicon steel plate was further superposed on the side of the 85th alloy thin strips. At this time, the alloy thin strips were layered so that both end portions in the width direction of the directional silicon steel plate and both end portions of the respective alloy thin strips (2550 sheets in total) overlapped each other.

Next, 30 sheets of the first alloy thin strips were bent in an annular shape (toroidal shape) such that the both end portions in the longitudinal direction thereof overlapped each other by from 15 mm to 25 mm while maintaining the state in which the positions of the respective alloy thin strips and the directional silicon steel plate were fixed so that they do not move.

Next, 30 sheets of the second alloy thin strips were bent into an annular shape such that the both end portions in the longitudinal direction thereof overlapped each other by from 15 mm to 25 mm.

This operation was sequentially conducted in the same manner for the third to 84th alloy thin strips (30 sheets for each) as well.

Next, 30 sheets of the 85th alloy thin strips were bent in an annular shape such that the both end portions in the longitudinal direction thereof overlapped each other by from 10 mm to 20 mm.

Next, the directional silicon steel plate, which is to be the outermost periphery, was bent into an annular shape such that it followed along the 30 sheets of the 85th alloy thin strips bent into an annular shape and such that the both end portions in the longitudinal direction thereof overlapped each other, and the overlapped both end portions in the longitudinal direction were fixed with a heat-resistant tape. At this time, the position at which the directional silicon steel plate overlapped was the position at which the both end portions in the longitudinal direction of the 30 sheets of the 85th alloy thin strips overlapped each other by from 10 mm to 20 mm.

Finally, the diameter of the ring of the first to 84th alloy thin strips bent into an annular shape was expanded so as to follow along the 85th alloy thin strips, and the first to 84th alloy thin strips all thus overlapped each other by from 10 mm to 20 mm.

An annular first composite including an annular layered body formed by layering amorphous alloy thin strips one on another and an annular outer peripheral surface side silicon steel plate was thus obtained.

The annular first composite thus obtained was molded by using a molding jig so as to have a rectangular annular shape as illustrated in FIG. 1 and fixed. At this time, a rectangular annular directional silicon steel plate (plate thickness: 0.27 mm, plate width: 170 mm) as the inner peripheral surface side silicon steel plate was fitted into the innermost periphery (the first alloy thin strip side) of the magnetic core.

As the core (magnetic core) before being subjected to the hole forming step, a rectangular annular second composite including a layered body of annular amorphous alloy thin strips, an outer peripheral surface side silicon steel plate, and an inner peripheral surface side silicon steel plate was thus obtained.

In the second composite (namely, the magnetic core before being subjected to the hole forming step) thus obtained, the long side length of the outer periphery of the magnetic core (the length in the longitudinal direction of the magnetic core) was 418 mm and the short side length of the outer periphery of the magnetic core (the length in the direction orthogonal to the longitudinal direction of the magnetic core) was 236 mm.

In this magnetic core, the sum of the thickness in the layering direction of the layered body (the thickness T1 in FIG. 2), the thickness of the inner peripheral surface side silicon steel plate, and the thickness of the outer peripheral surface side silicon steel plate was 73 mm.

<Hole Forming Step>

Next, a metal bar having a diameter of 5 mm and having a pointed tip was inserted into the position that was on the center line of the long side length (the position bisecting the long side length; on the center line C2 in FIG. 2) and the center line in the layering direction (the position equally distant from the inner peripheral surface and the outer peripheral surface; on the center line C1 in FIG. 2) on the long side portion of one end face (one end face in the width direction of the thin strip) of the second composite in a state of being fixed by the molding jig in a direction perpendicular to one end face of the magnetic core. The interval between one thin strip and another thin strip was thus partially expanded and a hole for thermocouple insertion was formed. The depth of this hole was set to 85 mm (half of the width of the thin strips). Incidentally, this hole is entirely included in a range (the range X1 indicated by an oblique line in FIG. 2) from one end to another end in the longitudinal direction of the inner peripheral surface on the one end face, when viewed from the side of one end face.

Next, a sheath type thermocouple having a diameter of 1.6 mm was inserted into the hole in a state in which the metal bar was inserted, and the metal bar was then removed from the second composite.

<Heat Treatment Step>

Next, the second composite (second composite in a state in which a sheath type thermocouple was inserted to the second composite and the second composite was fixed by the molding jig) from which the metal bar was removed was placed in a heat treating furnace. As the heat treating furnace, a heat treating furnace equipped with a heater for heating at the upper portion and a mechanism for air circulation of the interior was used.

Next, heat treatment of the second composite was conducted while measuring the internal temperature of the hole by the thermocouple.

The heat treatment was conducted in a magnetic field by disposing a conducting wire at the center (the center of the inner periphery) of the second composite so that a magnetic flux is generated in the closed magnetic path direction of the second composite and allowing a direct current of 1,800 A to flow through the conducting wire to generate a magnetic field.

The condition for the heat treatment described above was a condition in which the following operations of Step 1 to Step 4 were sequentially carried out (see FIG. 8 and FIG. 9 to be described later).

Step 1 . . . the air was circulated in the furnace, the temperature was raised to have a furnace temperature of 340° C., and the operation was shifted to Step 2 at the stage at which the internal temperature of the second composite (the temperature measured by the thermocouple, the same applies hereinafter) reached 310° C. or higher.

Step 2 . . . the temperature was lowered to have a furnace temperature of 330° C. while circulating the air in the furnace, and the operation was shifted to Step 3 at the stage at which the internal temperature of the second composite reached 315° C. or higher.

Step 3 . . . the temperature was lowered to have a furnace temperature of 320° C. and kept for 70 minutes.

Step 4 . . . the temperature was lowered to have a furnace temperature of 0° C., and the air was sent into the furnace by using a fan. The heat treatment was terminated at the stage at which the internal temperature of the second composite reached 200° C. or lower, the door of the heat treating furnace was opened, and the second composite was taken out from the heat treating furnace.

The thermocouple was pulled out from the second composite after the second composite was taken out from the heat treating furnace.

The width (width Wh in FIG. 3) of the hole from which the thermocouple was pulled out was 2.5 mm, and the length of the hole (length Lh in FIG. 3) was 20 mm.

<Resin Layer Forming Step>

An epoxy resin composition (the following resin composition 1) was coated on a part (a region including the hole) of the one end face of the second composite and cured to form a resin layer, thereby obtaining a magnetic core (core). The details will be described below.

As the epoxy resin composition for forming the resin layer, a two-liquid mixed type resin composition 1 containing liquid A and liquid B was used. This resin composition 1 is a two-liquid mixed type epoxy resin composition manufactured by Meiden Chemical Co., Ltd. The compositions of liquid A and liquid B are as follows.

—Composition of Liquid A in Resin Composition 1 (100% by mass in total)—

Bisphenol A type liquid epoxy resin (CAS No. 25068-38-6) . . . from 25 to 35% by mass Bisphenol A bis(propylene glycol glycidyl ether) ether (CAS No. 36484-54-5) . . . from 35 to 45% by mass Silica (CAS No. 14808-60-7) . . . from 25 to 35% by mass Pigment and others (CAS No. 67762-90-7, 13463-67-7, 1333-86-4) . . . less than 5% by mass —Composition of Liquid B in Resin Composition 1—

Modified aliphatic polyamine (CAS No. 39423-51-3 and others) . . . 81% by mass

Isophoronediamine (CAS No. 2855-13-2) . . . 19% by mass

The liquid A and the liquid B were mixed at the mixing ratio presented in the following Table 1 to prepare a resin composition 1 and the resin composition 1 thus obtained was coated on a part (region including the hole) of the one end face of the second composite by using a spatula (coating unit) within one hour after mixing of the liquid A and the liquid B. The region to be coated with the resin composition 1 (namely, the region in which the resin layer is formed) was the same region as the region in which the resin layer 40A in FIG. 6 and FIG. 7 was formed. In other words, the region to be coated was a continuous region that was a part of a region other than the overlap portion 30 of the entire region of the one end face of the layered body 10 in the second composite, included the hole 20, and extended from the outer peripheral surface 18 to the inner peripheral surface 16.

Subsequently, the coated resin composition 1 was dried at room temperature for 3 hours.

Subsequently, the second composite coated with the resin composition 1 was placed in a furnace and heated at 100° C. for 2 hours to cure the resin composition 1, thereby obtaining a resin layer. Thereafter, the molding jig was removed from the second composite.

The resin composition 1 was coated on a part of another end face of the second composite (in detail, the region overlapping with the resin layer on the side of one end face when viewed from the side of one end face) and cured to form a resin layer in the same manner.

A magnetic core (core) having a configuration in which a resin layer was formed on a part of one end face (a region including the hole) and a part of another end face of the second composite was thus obtained.

<Measurement and Evaluation>

The resin composition 1 was subjected to the following measurements. Furthermore, the core after being subjected to formation of the resin layer was subjected to the following evaluation.

The results thereof are presented in the following Table 1.

(Viscosity and T. I. Value of Resin Composition)

The liquid A was put in a 200 mL plastic container, and the liquid B was added thereto, and the liquid A and the liquid B were thoroughly mixed for from 1 to 2 minutes by using a stainless steel spatula. At this time, the total amount of the liquid A and the liquid B was 150 g, and the ratio of the liquid A to the liquid B was the ratio presented in the following Table 1. A sample for viscosity measurement of the resin composition 1 was thus obtained.

The viscosity (viscosity at 50 rpm) of the sample for viscosity measurement thus obtained was measured by using a B type viscometer and a rotor (spindle) having a rotor No. 7 (spindle number: 7) under a condition in which a rotation speed of the rotator speed (a rotation speed of spindle) was 50 rpm and the temperature of the epoxy resin composition after mixing of the two liquids was 25° C. in conformity to JIS K 7117-1 (1999) within 5 minutes after preparation of the sample for viscosity measurement was completed (namely, after mixing of the liquid A and the liquid B was completed).

The viscosity at 5 rpm of the sample for viscosity measurement subjected to the measurement of the viscosity at 50 rpm was measured in the same manner as the viscosity at 50 rpm except that the rotation speed of the rotator was changed to 5 rpm immediately after the viscosity at 50 rpm was measured.

Here, as the B type viscometer, a B type viscometer "TVB-10" manufactured by TOKI SANGYO CO., LTD. was used.

(Hole Blocking Property of Resin Layer)

The hole portion of the core after being subjected to formation of the resin layer was visually observed, and the hole blocking property of the resin layer was evaluated according to the following evaluation criteria.

—Evaluation Criteria— a: Hole was completely blocked by resin layer, and hole blocking property of resin layer was excellent.

b: Hole was not blocked by resin layer, and hole blocking property of resin layer was poor.

(Flatness of Surface of Resin Layer)

The entire resin layer was visually observed in a state in which the surface of the resin layer was irradiated with the lamp light at an angle of 30° and the flatness of the surface of the resin layer was evaluated according to the following evaluation criteria.

—Evaluation Criteria— a: Shadow was not observed on surface of resin layer, and flatness of surface of resin layer was excellent.

b: Shadow was observed on surface of resin layer, and flatness of surface of resin layer was poor.

Examples 2 and 3 and Comparative Examples 1 and 2

The same operation as in Example 1 was conducted except that the kind of the resin composition used for forming the resin layer was changed to a resin composition 2 (Example 2), a resin composition 3 (Example 3), a comparative resin composition X (Comparative Example 1), or a comparative resin composition Y (Comparative Example 2) presented in able 1. The results are presented in Table 1.

In addition, the compositions of the liquid A and the liquid B in each of the resin composition 2, the resin composition 3, the comparative resin composition X, and the comparative resin composition Y are as follows.

In addition, the mixing ratio (mass ratio) of the liquid A to the liquid B in the respective resin compositions is as presented in Table 1.

—Composition of Liquid Ain Resin Composition 2 (100% by mass in total)—

Bisphenol A type liquid epoxy resin (CAS No. 25068-38-6) . . . from 25 to 35% by mass Bisphenol A bis(propylene glycol glycidyl ether) ether (CAS No. 36484-54-5) . . . from 40 to 50% by mass Silica (CAS No. 14808-60-7) . . . from 20 to 30% by mass Pigment and others (CAS No. 112945-52-5, 13463-67-7, 1333-86-4) . . . less than 5% by mass —Composition of Liquid B in Resin Composition 2—

Modified aliphatic polyamine (CAS No. 39423-51-3 and others) . . . 81% by mass

Isophoronediamine (CAS No. 2855-13-2) . . . 19% by mass

—Composition of Liquid Ain Resin Composition 3 (100% by mass in total)—

Bisphenol A type liquid epoxy resin (CAS No. 25068-38-6) . . . from 25 to 35% by mass Bisphenol A bis(propylene glycol glycidyl ether) ether (CAS No. 36484-54-5) . . . from 35 to 45% by mass Silica (CAS No. 14808-60-7) . . . from 25 to 35% by mass Pigment and others (CAS No. 112945-52-5, 13463-67-7, 1333-86-4) . . . less than 5% by mass —Composition of Liquid B in Resin Composition 3 (100% by mass in total)—

Modified aliphatic polyamine (CAS No. 39423-51-3 and others) . . . from 80 to 90% by mass Isophoronediamine (CAS No. 2855-13-2) . . . from 10 to 20% by mass m-xylylenediamine (CAS No. 1477-55-0) . . . less than 5% by mass —Composition of Liquid Ain Comparative Resin Composition X (100% by mass in total)—

Bisphenol A type liquid epoxy resin (CAS No. 25068-38-6) . . . from 20 to 30% by mass Bisphenol A bis(propylene glycol glycidyl ether) ether (CAS No. 36484-54-5) . . . from 30 to 40% by mass Talc (CAS No. 14807-96-6) . . . from 30 to 40% by mass Pigment and others (CAS No. 112945-52-5) . . . less than 5% by mass —Composition of Liquid B in Comparative Resin Composition X (100% by mass in total)—

Polyamidoamine . . . from 70 to 80% by mass 3,6,9-triazaundecane-1,11-diamine (CAS No. 112-57-2) . . . from 20 to 30% by mass Composition of Liquid A in Comparative Resin Composition Y (100% by mass in total)—

Bisphenol A type liquid epoxy resin (CAS No. 25068-38-6) . . . from 20 to 30% by mass Bisphenol A bis(propylene glycol glycidyl ether) ether (CAS No. 36484-54-5) . . . from 30 to 40% by mass Talc (CAS No. 14807-96-6) . . . from 30 to 40% by mass Pigment and others (CAS No. 112945-52-5) . . . less than 5% by mass —Composition of Liquid B in Comparative Resin Composition Y (100% by mass in total)—

Polyamidoamine . . . from 70 to 80% by mass 3,6,9-triazaundecane-1,11-diamine (CAS No. 112-57-2) . . . from 20 to 30% by mass

TABLE 1

| | | Example 1 | Example 2 | Example 3 | Comparative Example 1 | Comparative Example 2 |
|---|---|---|---|---|---|---|
| Resin composition | No. | 1 | 2 | 3 | X | Y |
| | Mixing ratio (mass ratio) of liquid A/liquid B | 100/23 | 100/25 | 100/23 | 100/12 | 100/11 |
| | Viscosity (Pa · s) | 45 | 51 | 38 | 44 | 33 |
| | T. I. value | 1.9 | 2.7 | 1.6 | 2.9 | 1.5 |
| Evaluation results | Hole blocking property | a | a | a | a | b |
| | Flatness of surface of resin layer | a | a | a | b | a |

—Explanation on Table 1—

The term "viscosity (Pa·s)" represents the viscosity at 50 rpm.

The term "T. I. value" represents a value obtained by dividing the viscosity at 5 rpm by the viscosity at 50 rpm (see Formula (1) described above).

As presented in Table 1, in Examples 1 to 3 in which the viscosity was within a range of from 38 Pa·s to 51 Pa·s and the T. I. value was within a range of from 1.6 to 2.7, the hole blocking property of the resin layer was excellent and the flatness of the surface of the resin layer was also excellent.

In contrast, in Comparative Example 1 in which the T. I. value was as large as 2.9, the shadow on the surface of the resin layer was clearly observed and the irregularities on the surface of the resin layer were confirmed to be large (that is, the flatness was poor) although the hole blocking property of the resin layer was excellent.

In addition, in Comparative Example 2 in which the viscosity is as small as 33 Pa·s and the T. I. value was also as small as 1.5, the hole blocking property of the resin layer was poor (that is, it was not possible to block the hole by the resin layer) although the flatness of the surface of the resin layer was excellent.

Next, as the confirmation of reproducibility, the cores of Examples 1 to 3 described above were fabricated by 10 pieces for each and subjected to the evaluation on the hole blocking property of the resin layer and the flatness of the surface of the resin layer. As a result, in all the cores, the hole blocking property of the resin layer was excellent (the evaluation result on the hole blocking property was "a") and the flatness of the surface of the resin layer was excellent (the evaluation result on the flatness of the surface of the resin layer was "a"). It has been thus confirmed that the results of Examples 1 to 3 in Table 1 are reproducible.

<Evaluation on Magnetic Properties>

Next, a conducting wire having a cross-sectional area of 2 $mm^2$ as a primary winding wire was wound around the core of Example 1 described above by 10 turns and the conducting wire as a secondary winding wire was wound therearound by 2 turns, to obtain a wound magnetic core.

Thus obtained wound magnetic core was subjected to an evaluation on the core loss (W/kg) and apparent power (VA/kg) at 1.4 T and 60 Hz.

As a result, the core loss was 0.26 W/kg and the apparent power was 0.48 VA/kg.

In this manner, favorable magnetic properties were imparted to the core by the heat treatment under the condition described above.

Next, the measurement results on the internal temperature profile of the second composite (internal temperature profile of the hole) under the heat treatment condition of the Example 1 described above are presented. Here, the results obtained when four pieces (hereinafter, referred to as cores 1 to 4) of the second composite from which the metal bar is removed (the second composite in a state in which a sheath type thermocouple is inserted to the second composite and the second composite is fixed by the molding jig) are prepared and these cores 1 to 4 are placed in one heat treating furnace and subjected to a heat treatment are presented.

Figure 8:
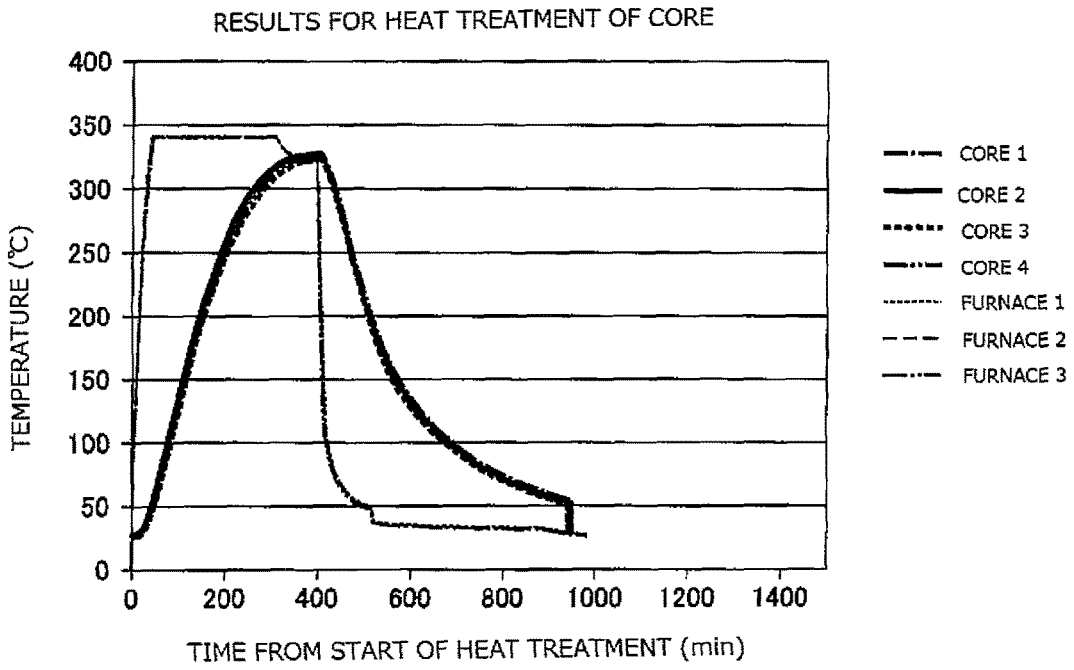
FIG. 8 is a graph illustrating the relation between the elapsed time (minutes) from the start of a heat treatment and the temperatures of a core (layered body) and a furnace in Example 1.

FIG. 8 is a graph illustrating the relation between the elapsed time (minutes) from the start of the heat treatment and the temperatures of the magnetic core and the furnace under the heat treatment condition described above, and FIG. 9 is a partially enlarged view of FIG. 8.

Figure 9:
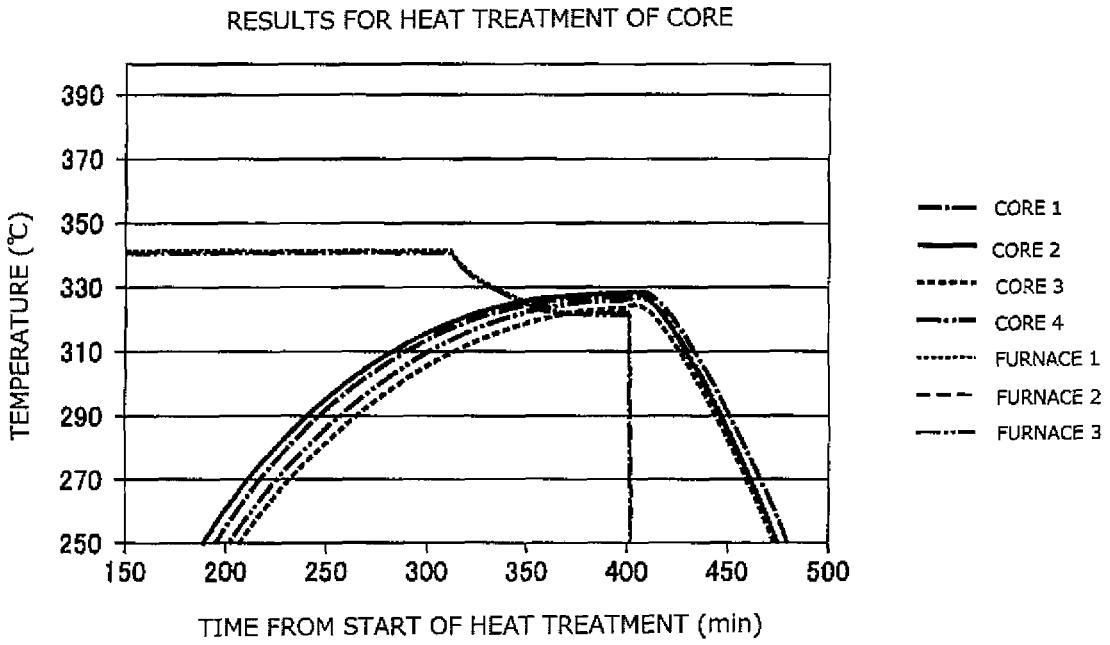
FIG. 9 is a partially enlarged view of FIG. 8.

In FIG. 8 and FIG. 9, the cores 1 to 4 respectively represent the internal temperature of the cores 1 to 4 (the temperature measured by the thermocouple), and the furnaces 1 to 3 represent the temperature at three points in the heat treating furnace.

As illustrated in FIG. 8 and FIG. 9, it was confirmed that the internal temperature profiles of the cores 1 to 4 were almost consistent with one another in the course of the heat treatment. Consequently, it was confirmed that the cores 1 to 4 were all subjected to a proper heat treatment for imparting favorable magnetic properties.

From the results described above, an effect is expected that it is possible to adjust the heat treatment condition while measuring the internal temperature of the core, that is, it is possible to easily optimize the heat treatment condition by providing the core (layered body) with a hole for thermocouple insertion.

Example 4

<Fabrication and Evaluation of Core having Other Shape>

A core (a core after being subjected to the resin layer forming step) was fabricated by conducting the same operation as in Example 1 except that the width of the amorphous alloy thin strips, the plate width of the outer peripheral side silicon steel plate, and the plate width of the inner peripheral side silicon steel plate were set to 142 mm, respectively, the long side length of the outer periphery of the magnetic core (length in the longitudinal direction of the magnetic core) was set to 302 mm, the short side length of the outer periphery of the magnetic core (the length in the direction orthogonal to the longitudinal direction of the magnetic core) was set to 164 mm, and the sum of the thickness (T1 in FIG. 2) in the layering direction of the layered body, the thickness of the inner peripheral surface side silicon steel plate, and the thickness of the outer peripheral surface side silicon steel plate was set to 53 mm by adjusting the number of thin strips.

As a result of evaluation on the magnetic properties, the core loss was 0.26 W/kg and the apparent power was 0.48 VA/kg in the core of Example 4.

As described above, it was confirmed that the heat treatment condition in Example 1 was also proper for the core (second composite) of Example 4 having a size different from that of the core (second composite) of Example 1.

The disclosure of Japanese Patent Application No. 2014-197344 is incorporated herein by reference in its entirety.

All documents, patent applications, and technical standards described in this specification are incorporated herein by reference to the same extent as if specifically and individually indicated as individual document, patent application, and technical standard are incorporated by reference.

The invention claimed is:

1. A method of manufacturing an amorphous alloy magnetic core, the method comprising:

a layered body preparing step of preparing a layered body by layering amorphous alloy thin strips one on another, the layered body having one end face and another end face in a width direction of the amorphous alloy thin strips and an inner peripheral surface and an outer peripheral surface orthogonal to a layering direction of the amorphous alloy thin strips;

a hole forming step of forming a hole passing through from the one end face of the layered body as a starting point, the width direction corresponding to a depth direction of the hole;

a heat treatment step of subjecting the layered body, after being subjected to the hole forming step, to a heat treatment while measuring an internal temperature of the hole; and a resin layer forming step of forming a resin layer which blocks the hole and covers at least a part of the one end face by coating and curing a two-liquid mixed type epoxy resin composition having a viscosity (25° C.) after mixing of two liquids measured under a condition of a rotation speed of 50 rpm of from 38 Pa·s to 51 Pa·s and a thixotropy index value (25° C.) after mixing of the two liquids determined by the following Formula (1) of from 1.6 to 2.7 on a region which is at least a part of at least the one end face of the layered body after being subjected to the heat treatment step and includes the hole:

Thixotropy index value (25° C.) after mixing of two liquids=viscosity at 5 rpm/viscosity at 50 rpm  Formula (1)

wherein, in Formula (1), the term "viscosity at 50 rpm" refers to the viscosity (25° C.) after mixing of the two liquids of the two-liquid mixed type epoxy resin composition measured under the condition of a rotation speed of 50 rpm and the term "viscosity at 5 rpm" refers to the viscosity (25° C.) after mixing of the two liquids of the two-liquid mixed type epoxy resin composition measured under the condition of a rotation speed of 5 rpm.

2. The method of manufacturing an amorphous alloy magnetic core according to claim 1, wherein the heat treatment is conducted on the layered body, which is disposed in a magnetic field in the heat treatment step.

3. The method of manufacturing an amorphous alloy magnetic core according to claim 1, wherein the layered body after being subjected to the hole forming step but before being subjected to the resin layer forming step is configured such that a shortest distance between a center of the hole and a center line in a thickness direction of the layered body is 10% or less with respect to a thickness of the layered body, when viewed from a side of the one end face in the layered body.

4. The method of manufacturing an amorphous alloy magnetic core according to claim 1, wherein the layered body after being subjected to the hole forming step but before being subjected to the resin layer forming step is configured such that the entire hole is included in a range from one end to another end in a longitudinal direction of the inner peripheral surface on the one end face, when viewed from a side of the one end face in the layered body.

5. The method of manufacturing an amorphous alloy magnetic core according to claim 1, wherein the layered body after being subjected to the hole forming step but before being subjected to the resin layer forming step is configured such that a shortest distance between a center of the hole and a center line in a longitudinal direction of the layered body is 20% or less with respect to a length in the longitudinal direction of the layered body, when viewed from a side of the one end face in the layered body.

6. The method of manufacturing an amorphous alloy magnetic core according to claim 1, wherein the layered body after being subjected to the hole forming step but before being subjected to the resin layer forming step is configured such that a depth of the hole is from 30% to 70% with respect to a distance between the one end face and the another end face in the layered body.

7. The method of manufacturing an amorphous alloy magnetic core according to claim 1, wherein the layered body after being subjected to the hole forming step but before being subjected to the resin layer forming step is configured such that a width of the hole is 1.5 mm or more in the layered body.

8. The method of manufacturing an amorphous alloy magnetic core according to claim 1, wherein the layered body after being subjected to the hole forming step but before being subjected to the resin layer forming step is configured such that a width of the hole is narrower than a value to be calculated by a mathematical formula $T\times(100-LF)/100$, wherein a thickness (mm) of the layered body is denoted as T and a space factor (%) of the amorphous alloy magnetic core is denoted as LF in the layered body.

9. The method of manufacturing an amorphous alloy magnetic core according to claim 1, wherein the layered body after being subjected to the hole forming step but before being subjected to the resin layer forming step is configured such that a width of the hole is 3.5 mm or less in the layered body.

10. The method of manufacturing an amorphous alloy magnetic core according to claim 1, wherein the layered body after being subjected to the hole forming step but before being subjected to the resin layer forming step is configured such that a length of the hole is from 1.5 mm to 35 mm in the layered body.

* * * * *